US010202218B2

(12) United States Patent
Eguchi et al.

(10) Patent No.: US 10,202,218 B2
(45) Date of Patent: Feb. 12, 2019

(54) DELAMINATABLE CONTAINER

(71) Applicant: KYORAKU CO., LTD., Kyoto (JP)

(72) Inventors: Tetsuaki Eguchi, Kanagawa (JP); Shinsuke Taruno, Kanagawa (JP); Yuji Yoneoka, Tokyo (JP); Yoshio Yamauchi, Tokyo (JP)

(73) Assignee: KYORAKU CO., LTD., Kyoto (JP)

( * ) Notice: Subject to any disclaimer, the term of this patent is extended or adjusted under 35 U.S.C. 154(b) by 0 days.

(21) Appl. No.: 15/545,884

(22) PCT Filed: Jan. 22, 2016

(86) PCT No.: PCT/JP2016/051806
§ 371 (c)(1),
(2) Date: Jul. 24, 2017

(87) PCT Pub. No.: WO2016/117668
PCT Pub. Date: Jul. 28, 2016

(65) Prior Publication Data

US 2018/0016050 A1 Jan. 18, 2018

(30) Foreign Application Priority Data

Jan. 23, 2015 (JP) ..... 2015-011190
Mar. 23, 2015 (JP) ..... 2015-059592
(Continued)

(51) Int. Cl.
*B65D 1/02* (2006.01)
*B65D 77/06* (2006.01)
(Continued)

(52) U.S. Cl.
CPC ..... *B65D 1/0238* (2013.01); *B65D 1/02* (2013.01); *B65D 1/0215* (2013.01);
(Continued)

(58) Field of Classification Search
CPC .. B65D 1/0238; B65D 1/0215; B65D 1/0246; B65D 77/065; B65D 77/067; B65D 79/005; B65D 2501/0036
(Continued)

(56) References Cited

U.S. PATENT DOCUMENTS 3,592,365 A * 7/1971 Schwartzman .... B65D 47/2075 222/209
3,768,682 A * 10/1973 Meyers ..... A61J 9/04 215/11.5
(Continued)

FOREIGN PATENT DOCUMENTS

JP S63-12427 A 1/1988
JP H04-267727 A 9/1992
(Continued)

OTHER PUBLICATIONS

Partial Supplementary European Search Report dated Oct. 20, 2017 from corresponding European application No. 16740275.9; 11pgs.
(Continued)

*Primary Examiner* — Kareen K Thomas
(74) *Attorney, Agent, or Firm* — Maier & Maier, PLLC

(57) ABSTRACT

Provided is a delamination container having improved oxygen barrier properties. The present invention provides a delamination container provided with a container body having an outer shell and an inner pouch, the inner pouch being adapted to delaminate from the outer shell and contract in association with a decrease of the contents, wherein the inner layer constituting the inner pouch is provided with, in order from the container outer surface side, an outside layer, an adhesive layer, and an inside layer. The outside layer includes an EVOH layer, and the inside layer has a thickness of 60-200 μm and a flexural modulus of 250 MPa or less, the value (thickness of the inside layer/thickness of
(Continued)

the EVOH layer) being 1.1-5, and the total thickness of the inside layer being 100-250 μm.

17 Claims, 19 Drawing Sheets

(30) Foreign Application Priority Data

Mar. 31, 2015 (JP) ..... 2015-071562
Apr. 27, 2015 (JP) ..... 2015-090676

(51) Int. Cl.
*B65D 83/00* (2006.01)
*B65D 79/00* (2006.01)

(52) U.S. Cl.
CPC ..... *B65D 1/0246* (2013.01); *B65D 77/065* (2013.01); *B65D 83/0055* (2013.01); *B65D 77/067* (2013.01); *B65D 79/005* (2013.01); *B65D 2501/0036* (2013.01)

(58) Field of Classification Search
USPC ..... 222/1; 215/12.2, 378, 382; 428/35.7
See application file for complete search history.

(56) References Cited

U.S. PATENT DOCUMENTS

| | | | | |
|---|---|---|---|---|
| 4,089,443 | A * | 5/1978 | Zrinyi | B65D 83/62 222/386.5 |
| 5,242,085 | A | 9/1993 | Richter et al. | |
| 5,242,086 | A | 9/1993 | Richter et al. | |
| 5,332,121 | A * | 7/1994 | Schmidt | B29C 45/1646 222/105 |
| 5,344,045 | A | 9/1994 | Richter et al. | |
| 5,381,927 | A | 1/1995 | Richter et al. | |
| 5,383,576 | A | 1/1995 | Richter et al. | |
| 5,385,269 | A | 1/1995 | Richter et al. | |
| 5,433,347 | A | 7/1995 | Richter et al. | |
| 6,266,943 | B1 | 7/2001 | Nomoto et al. | |
| 6,456,903 | B1 | 9/2002 | Rosenbaum et al. | |
| 6,670,007 | B1 | 12/2003 | Safian et al. | |
| 2001/0027154 | A1 | 10/2001 | Nomoto et al. | |
| 2004/0076782 | A1 | 4/2004 | Safian et al. | |
| 2004/0112921 | A1 | 6/2004 | Nomoto et al. | |
| 2006/0226171 | A1 * | 10/2006 | Sternberg | B65D 83/0055 222/95 |
| 2007/0292646 | A1 | 12/2007 | Safian et al. | |
| 2014/0190992 | A1 | 7/2014 | Kuwagaki et al. | |
| 2015/0298890 | A1 | 10/2015 | Miyairi et al. | |

FOREIGN PATENT DOCUMENTS

| | | | |
|---|---|---|---|
| JP | H04-115114 | U | 10/1992 |
| JP | H06-13099 | Y2 | 4/1994 |
| JP | 3650175 | B2 | 3/1997 |
| JP | H09-175566 | A | 7/1997 |
| JP | 2000-335635 | A | 12/2000 |
| JP | 2003-192031 | A | 7/2003 |
| JP | 2004-196357 | A | 7/2004 |
| JP | 2004-231280 | A | 8/2004 |
| JP | 2006182389 | A | 7/2006 |
| JP | 2010-274963 | A | 12/2010 |
| JP | 2013-035557 | A | 2/2013 |
| JP | 2013-133118 | A | 7/2013 |
| JP | 2014-019492 | A | 2/2014 |
| JP | 2014-091537 | A | 5/2014 |

OTHER PUBLICATIONS

Third Party Pre-issuance Submission dated Feb. 2, 2018, in corresponding JP Application No. JP2015-059592; 30 pgs.
International Search Report dated Apr. 19, 2016 from corresponding International Patent Application No. PCT/JP2016/051806; 4 pgs.
Chinese Office Action dated Jun. 21, 2018, in connection with corresponding CN Application No. 201680006893.8 (19 pgs., including English translation).
Korean Office Action dated May 19, 2018 from corresponding Korean Patent Application No. 10-2017-7021914; 14 pgs.

* cited by examiner

Fig. 2 A-A SECTIONAL VIEW
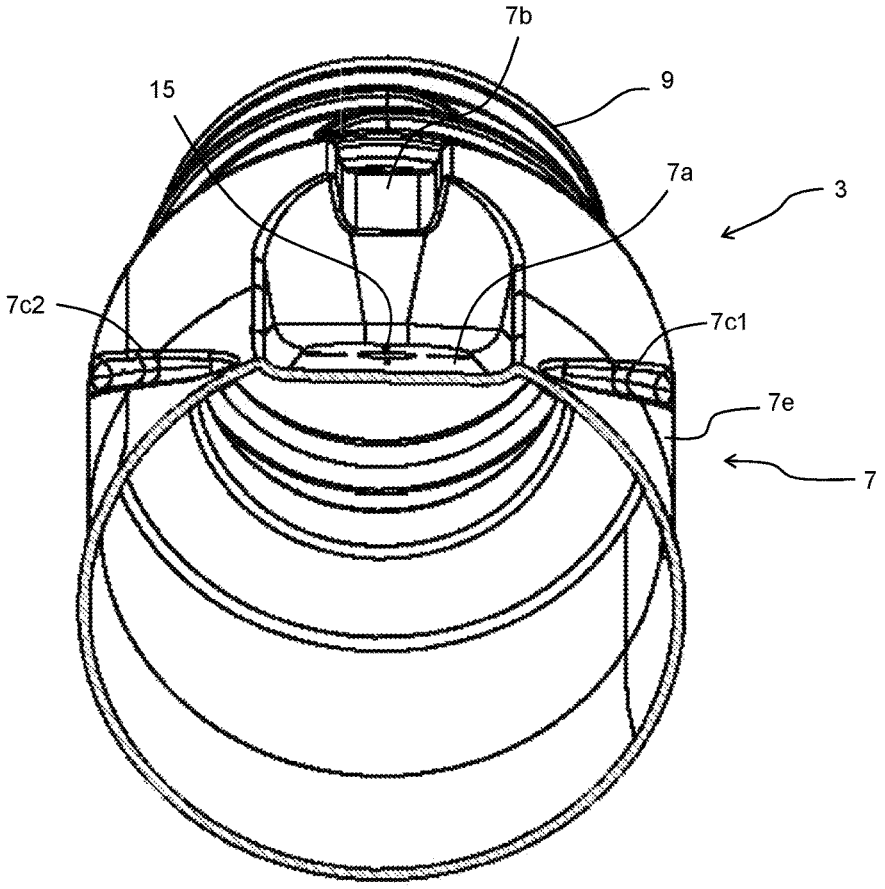

Fig. 3 B-B SECTIONAL VIEW
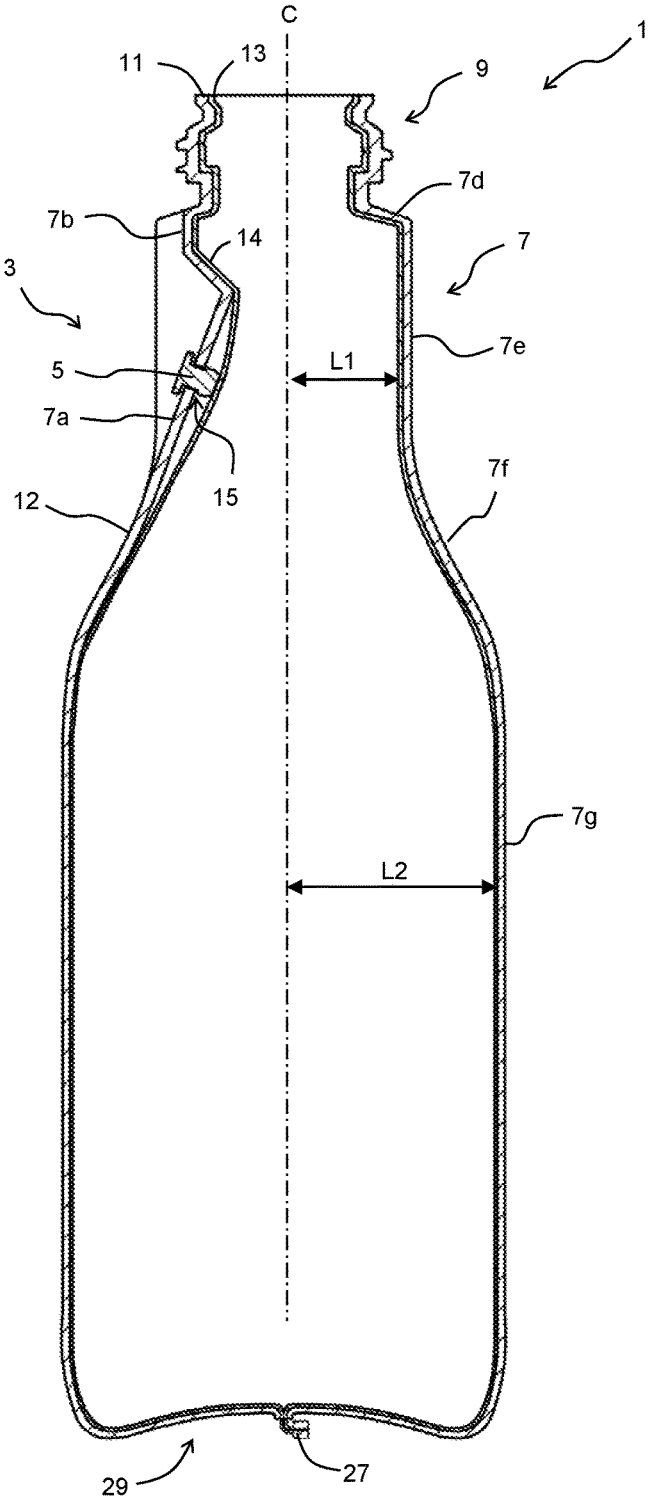

CONVENTIONAL TECHNIQUE

ENLARGED VIEW OF REGION A

Fig. 11A B-B SECTIONAL VIEW
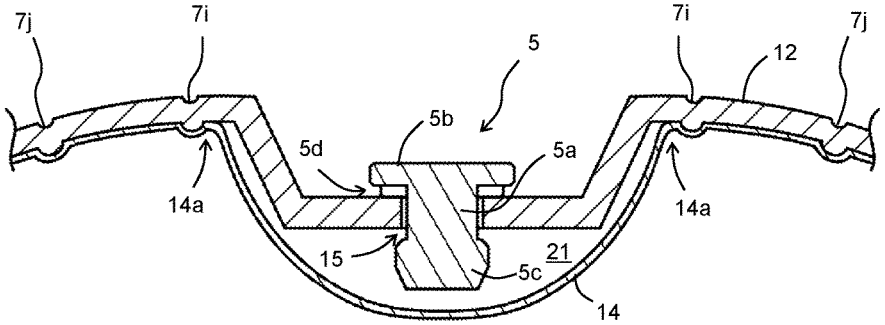
Fig. 11B
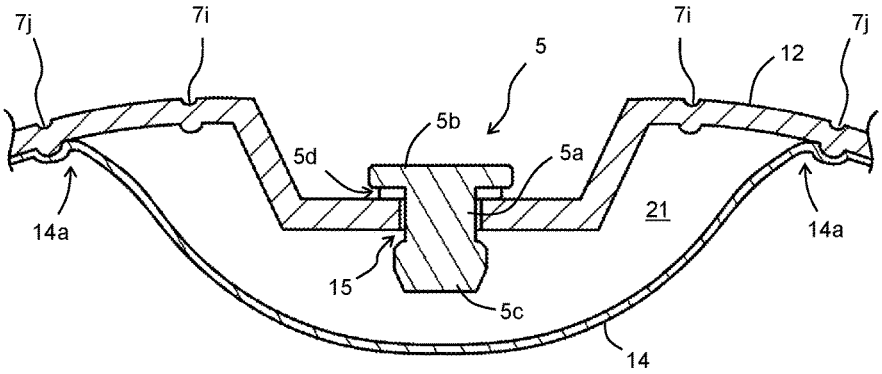

C-C SECTIONAL VIEW

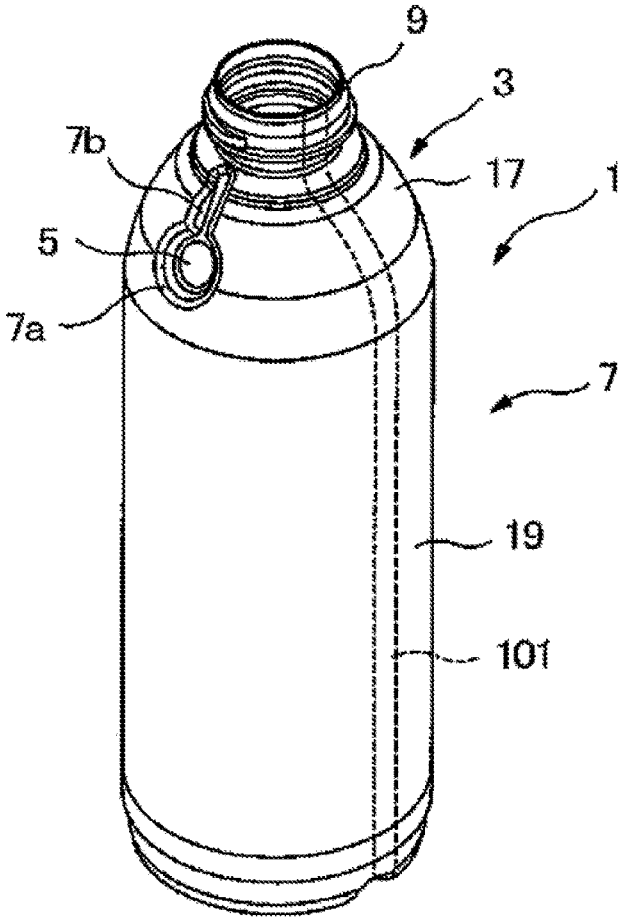
Fig. 16A
Fig. 16B
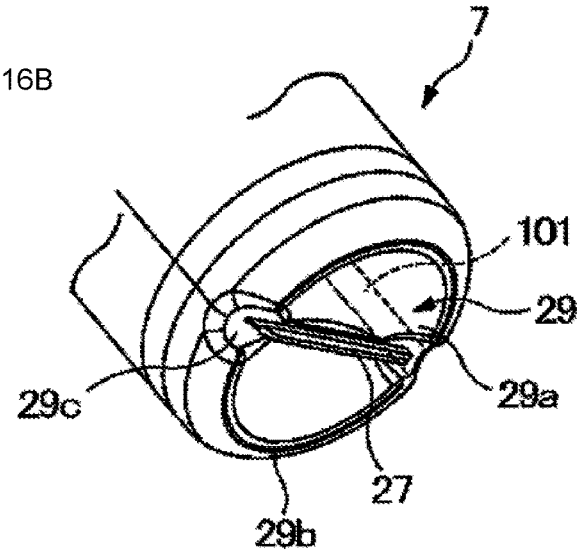

DELAMINATABLE CONTAINER

TECHNICAL FIELD

The present invention relates to a delaminatable container.

BACKGROUND ART

Conventionally, delaminatable containers are known that inhibit entrance of air inside the container by an inner layer delaminated from an outer layer and shrunk with a decrease in the contents (e.g., PTLs 1 to 4). Such delaminatable container is provided with an inner bag composed of an inner layer and an outer shell composed of an outer layer.

CITATION LIST

Patent Literature

PTL 1: Japanese Patent No. 3650175
PTL 2: JP 2014-91537A
PTL 3: JP 4-267727A
PTL 4: JP 2013-35557A

SUMMARY OF INVENTION

Technical Problem

First Aspect

Examples of such a delaminatable container include a container provided with an EVOH layer in an inner layer. Employment of such layer configuration gives excellent oxygen barrier properties to the EVOH layer and enables production of a delaminatable container excellent in oxygen barrier properties.

The present inventors made an investigation to unfortunately learn that even higher oxygen barrier properties may be required for some use.

The first aspect of the present invention has been made in view of such circumstances and is to provide a delaminatable container with improved oxygen barrier properties.

Second Aspect

In PTL 2, to solve the problem of not smoothly introducing fresh air between the outer shell and the inner bag after discharging the contents, vertical ribs are provided in a region extending at a central angle of 90 degrees downward from a fresh air inlet formed in the mouth.

The technique in PTL 2 is premised on formation of the fresh air inlet in the mouth of the container. The technique is thus difficult to be applied to a delaminatable container provided with a fresh air inlet in the storage portion of the container.

The second aspect of the present invention has been made in view of such circumstances and is to provide a delaminatable container, having a fresh air inlet in the storage portion of the container, capable of smoothly introducing fresh air between the outer shell and the inner bag.

Third Aspect

The present inventors found that, when a shrink film is mounted to the outer circumference of such a delaminatable container as in PTL 3, the outer shell after discharging the contents sometimes does not smoothly restore its original shape.

The third aspect of the present invention has been made in view of such circumstances and is to provide a delaminatable container with an outer shell excellent in restorability even when a shrink film is mounted to the container body.

Fourth Aspect

Delaminatable containers have an inner bag delaminated from an outer shell to be shrunk, thereby pouring out, for example, liquid contents. They thus have a problem that, depending on the form of shrinkage of the inner bag, an area like a liquid pool turns out to be generated and it is difficult to use up all the contents in the inner bag. In order to improve such a situation, improvements are under review, such as providing a plurality of adhesion strips to adhere the outer shell to the inner bag in strips, but not yet optimized.

The fourth aspect of the present invention has been made in view of such circumstances and is to provide a delaminatable container allowing the contents to be certainly used up fully.

Solution to Problem

A description is given below to solutions to the problems in the first to fourth aspects. The solutions in the first to fourth aspects below may be combined with each other.

First Aspect

The first aspect of the present invention provides a delaminatable container, containing a container body having an outer shell and an inner bag, the inner bag to be shrunk with a decrease in contents, wherein the inner bag is composed of an inner layer including an outside layer, an adhesion layer, and an inside layer in order from a container outer surface side, the outside layer includes an EVOH layer, the inside layer has a thickness from 60 to 200 μm and a bending modulus of elasticity of 250 MPa or less, a value of (thickness of the inside layer/thickness of the EVOH layer) is from 1.1 to 5, and the entire inner layer has a thickness from 100 to 250 μm.

The present inventors made an investigation to improve oxygen barrier properties and found that the moisture content contained in the contents stored in the container reaches the EVOH layer through the inside layer and the adhesion layer, causing a decrease in oxygen barrier properties of the EVOH layer.

To solve the problem of the decrease in oxygen barrier properties based on such findings, the EVOH layer was first made thicker than a conventional one. Since the EVOH layer, however, has high rigidity, it was found that a thicker EVOH layer caused a problem of higher rigidity of the inner layer, resulting in difficulty in shrinkage of the inner bag.

Then, not to allow the moisture content contained in the contents to readily reach the EVOH layer, the inside layer was made thicker that was formed of low-density polyethylene, linear low-density polyethylene, or the like. Even in this case, however, the rigidity of the inner layer increased and the problem of the inner bag not readily being shrunk arose.

In such a situation, the present inventors found that deterioration of shrinkability of the inner bag was inhibited while a decrease in oxygen barrier properties was effectively inhibited when all of the thickness of the inside layer, the bending modulus of elasticity of the inside layer, the ratio of thickness of the inside layer to that of the EVOH layer, and the thickness of the entire inner layer are within specific numerical ranges, and thus have come to complete the first aspect of the present invention.

A thickness of each layer herein means a thickness in a thinnest area of the container body.

Various embodiments in the first aspect of the present invention are described below as examples. The embodiments below may be combined with each other.

Preferably, the inside layer contains low-density polyethylene or linear low-density polyethylene.

Preferably, the inside layer has a thickness from 70 to 150 μm and a bending modulus of elasticity of 200 MPa or less, the value of (thickness of the inside layer/thickness of the EVOH layer) is from 1.5 to 4, and the entire inner layer has a thickness from 120 to 200 μm.

Second Aspect

The second aspect of the present invention provides a delaminatable container, comprising: a storage portion to store contents; a mouth to discharge the contents from the storage portion; and a container body having an outer shell and an inner bag, the inner bag to be shrunk with a decrease in contents, wherein the outer shell includes a fresh air inlet, in the storage portion, communicating an external space of the container body with an intermediate space between the outer shell and the inner bag, and grooved ribs are provided to sandwich the fresh air inlet.

During development of a delaminatable container with a fresh air inlet in the storage portion of the container, the present inventors found that it was sometimes difficult to restore the shape of the outer shell after the first discharge of the contents. On detailed investigation of the cause, they found that an inner bag with relatively high rigidity was not readily deflated, and as a result, the inner bag pressed the valve member against the outer shell or the inner bag closely contacted with the valve member to close the vent of the valve member not to readily and smoothly introduce fresh air into a space between the outer shell and the inner bag. They made an investigation to facilitate deflation of the inner bag based on the findings to find that grooved ribs provided to sandwich the fresh air inlet were capable of facilitating deflation of the inner bag, and thus have come to complete the second aspect of the present invention.

Various embodiments in the second aspect of the present invention are described below as examples. The embodiments below may be combined with each other.

Preferably, the grooved ribs are provided to sandwich the fresh air inlet from both sides in a circumferential direction of the storage portion.

Preferably, the grooved ribs includes first and second grooved ribs provided to extend inclined circumferentially away from the fresh air inlet toward the mouth.

Preferably, the first and second grooved ribs are provided at an angle from 30 to 100 degrees in a front view .

Preferably, the first and second grooved ribs are provided to have an intersection of extensions thereof, a distance between the intersection and a center of the fresh air inlet being from 5 to 35 mm in a front view.

Preferably, the fresh air inlet and the grooved ribs are provided in an approximately same plane.

Preferably, the grooved ribs extend to arcuately surround the fresh air inlet.

Preferably, the grooved ribs are composed of a plurality of grooves separated from each other in a circumferential direction of the grooved ribs.

Preferably, the grooved ribs include a plurality of arcs separated from each other in a direction away from the fresh air inlet.

Preferably, the fresh air inlet is formed in a valve member mounting recess provided in the storage portion, and the grooved ribs are provided to sandwich the valve member mounting recess.

Preferably, the grooved ribs have a semicircular cross section.

Third Aspect

The second aspect of the present invention provides a delaminatable container comprising: a container body; a cap; and a tubular shrink film, wherein the container body is configured to include a storage portion to store contents and a mouth to discharge the contents from the storage portion, the storage portion and the mouth having an outer layer and an inner layer, and having an inner bag composed of the inner layer to be shrunk with a decrease in the contents, the cap is mounted to the mouth, the shrink film is provided to closely contact with an outer circumference of the storage portion, the outer shell includes a fresh air inlet, in the storage portion, communicating an external space with an intermediate space between the outer shell and the inner bag, and the shrink film is provided to cover the fresh air inlet and has a vent to introduce fresh air into the fresh air inlet.

The present inventors made an investigation into why mounting of a shrink film caused deterioration of the restorability of the outer shell and found that, in a delaminatable container provided with a fresh air inlet in the storage portion of the container body as in PTL 1, the shrink film mounted to closely contact with the outer circumference of the storage portion turns out to close the fresh air inlet and not to smoothly introduce fresh air between the outer shell and the inner bag, resulting in deterioration of restorability of the outer shell.

Based on such findings, the present inventors found that a vent provided in the shrink film to introduce fresh air into the fresh air inlet allowed prevention of the deterioration of the restorability of the outer shell even when the shrink film is mounted, and thus have come to complete the third aspect of the present invention.

Various embodiments in the third aspect of the present invention are described below as examples. The embodiments below may be combined with each other.

Preferably, the vent is provided to introduce fresh air into the fresh air inlet regardless of a relative circumferential position of the shrink film to the container body.

Preferably, the vent is composed of a large number of pores provided along a circumference of the shrink film.

Preferably, the vent is composed of a large number of pores provided along an axis of the shrink film.

Preferably, the fresh air inlet is provided in a recess formed in the storage portion, and the shrink film is provided to cover the recess.

Preferably, the shrink film is provided to closely contact with an outer circumference of the storage portion and the cap.

Fourth Aspect

The fourth aspect of the present invention provides a delaminatable container, comprising: a container body having an outer shell and an inner bag, the inner bag to be shrunk with a decrease in contents; and a valve member to regulate entrance and exit of air between an external space of the container body and an intermediate space between the outer shell and the inner bag, wherein the container body includes a storage portion to store the contents and a mouth to discharge the contents from the storage portion, a lid is assembled to the mouth, the container body has a bottom formed with an approximately linear pinch-off, and one adhesion strip extending heightwise of a side wall is formed in a position of the side wall intersecting an extension of one end of the pinch-off.

In the delaminatable container of the fourth aspect of the present invention, the inner bag is linearly supported at the bottom by the pinch-off and the inner bag is shrunk from both sides across the pinch-off with discharge of the contents. Since the adhesion strip is formed in a direction orthogonal to the pinch-off, an approximately triangular space remains along the adhesion strip before finishing the discharge and the space constitutes a passage. The passage of the contents is accordingly secured until the end, and the delaminatable container is tilted to have the adhesion strip positioned downward to immediately discharge the contents remaining at the end through the passage.

The fourth aspect of the present invention provides a delaminatable container allowing the contents to be certainly used up fully because a liquid pool and the like are not generated due to random shrinkage of the inner bag and a linear small space is formed as a passage along the adhesion strip before finishing the discharge.

Preferably, the lid is assembled to the mouth to have a hinge in a position approximately 180° opposite to a position to form the adhesion strip.

BRIEF DESCRIPTION OF DRAWINGS

Drawings of Embodiments in the First to Third Aspects of the Invention

FIG. 1A is a front view, FIG. 1B is a perspective view.

FIG. 2 is an A-A cross-sectional view in FIG. 1A.

FIG. 3 is a cross-sectional view illustrating a state of mounting a valve member 5 to the container body 3 in FIGS. 1A-1B and bending bottom seal protrusion 27 corresponding to a B-B cross section in FIG. 1A.

FIG. 8A illustrates a state before bending the bottom seal protrusion 27 and FIG. 8B illustrates a state after bending the bottom seal protrusion 27.

FIG. 10A is a front view and FIG. 10B is an enlarged view of a region A in FIG. 10A.

FIGS. 11A-11B illustrate a B-B cross section in FIG. 10B in a state of mounting a valve member 5 to the container body 3 in FIGS. 10A-10B, where FIG. 11A illustrates a state of forming a bent portion 14*a* in an inner bag 14 at an edge of inside arcs 7*i* and FIG. 11B illustrates a state of forming a bent portion 14*a* in the inner bag 14 at an edge of outside arcs 7*j*.

FIG. 13A illustrates a state of an inner bag 14 after preliminary delamination and FIG. 13B illustrates a state of the inner bag 14 after filling contents.

In FIG. 14C, the area covered with the shrink film 31 is represented by a broken line.

FIGS. 15A-15C do not show the area covered with the shrink film 31.

Drawings of Embodiment in the Fourth Aspect of the Invention

FIGS. 16A-16B illustrate a structure of a delaminatable container in a fourth embodiment of the present invention, where FIG. 16A illustrates an overall view and FIG. 16B illustrates the bottom.

Figure 17A:
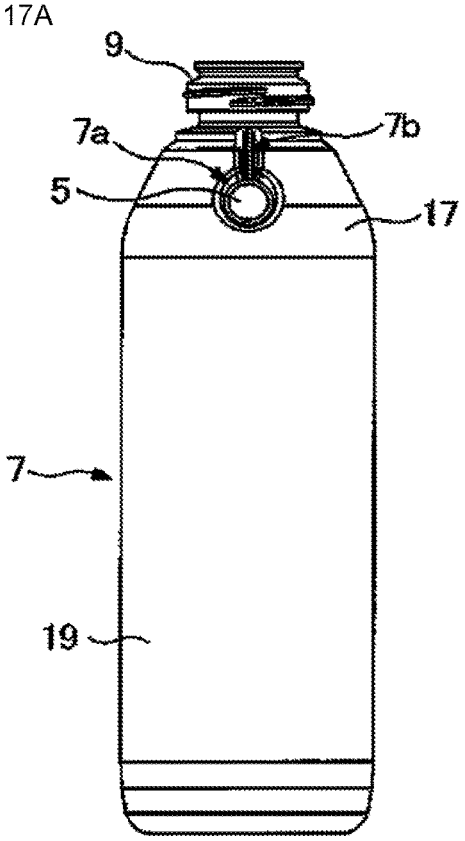
Figure 17B:
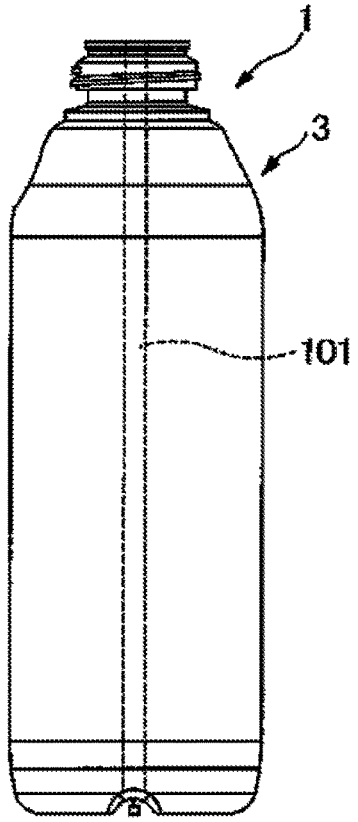
Figure 17C:
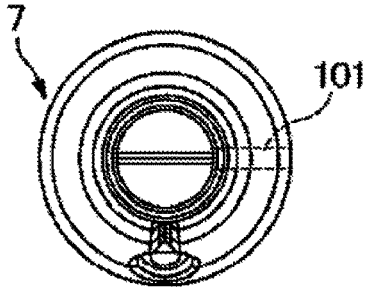
Figure 17D:
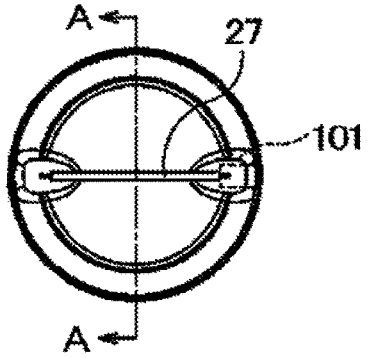

FIGS. 17A-17D illustrate the delaminatable container in FIGS. 16A-16B, where FIG. 17A is a front view, FIG. 17B is a rear view, FIG. 17C is a plan view, and FIG. 17D is a bottom view.

Figure 18:
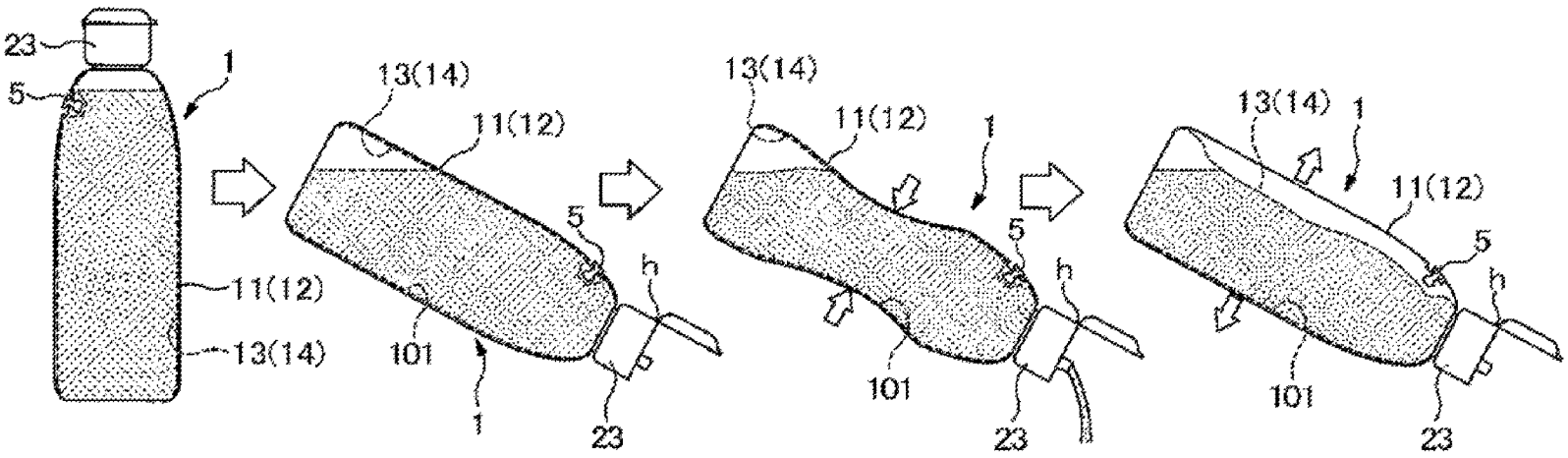

FIG. 18 is a drawing illustrating how to use the delaminatable container in the fourth embodiment of the present invention, where a state before use, a tilted state, a squeezed state, and a state of fresh air introduction are illustrated.

Figure 19A:
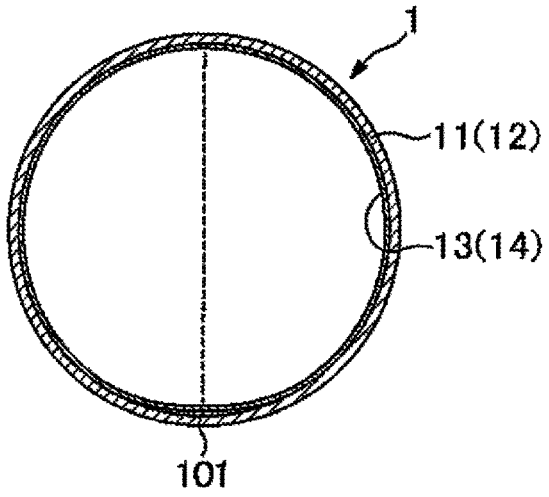
Figure 19B:
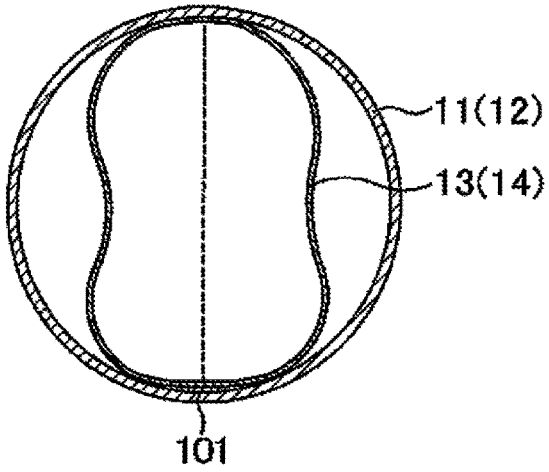
Figure 19C:
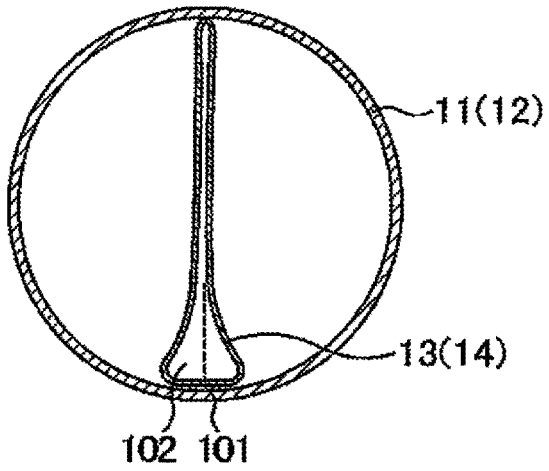

FIGS. 19A-19C are transverse cross-sectional views illustrating a shrinking state of an inner bag during use of the delaminatable container in the fourth embodiment of the present invention, where FIG. 19A illustrates a state before use, FIG. 19B illustrates a shrinking state, and FIG. 19C illustrates a state immediately before finishing using.

DESCRIPTION OF EMBODIMENTS

Embodiments of the present invention are described below. Various characteristics in the embodiments described below may be combined with each other. Each characteristic is independently inventive. Descriptions are given to embodiments in the first to third aspects of the present invention first, and then to embodiments in the fourth aspect of the present invention. The characteristics described in the embodiments of the first to third aspects may be combined with the characteristics described in embodiments of the fourth aspect.

Embodiments in the First to Third Aspects of the Invention

1. First Embodiment

As illustrated in FIGS. 1A through 4, a delaminatable container 1 in the first embodiment of the present invention is provided with a container body 3 and a valve member 5. The container body 3 is provided with a storage portion 7 to store the contents and a mouth 9 to deliver the contents from the storage portion 7.

As illustrated in FIG. 3, the container body 3 includes an outer layer 11 and an inner layer 13 in the storage portion 7 and the mouth 9, where the outer layer 11 constitutes an outer shell 12 and the inner layer 13 constitutes an inner bag 14. Due to separation of the inner layer 13 from the outer layer 1 with a decrease in the contents, the inner bag 14 separates from the outer shell 12 to be shrunk. Preliminary delamination is sometimes performed to delaminate the inner layer 13 from the outer layer 11 prior to storage of the contents in the storage portion 7. In this case, the inner layer 13 is contacted with the outer layer 11 by blowing air or storing the contents in the storage portion 7 after preliminary delamination. The inner layer 13 then separates from the outer layer 11 with a decrease in the contents. Meanwhile, when preliminary delamination is not performed, the inner layer 13 is delaminated from the outer layer 11 in discharge of the contents to separate from the outer layer 11.

Figure 4:
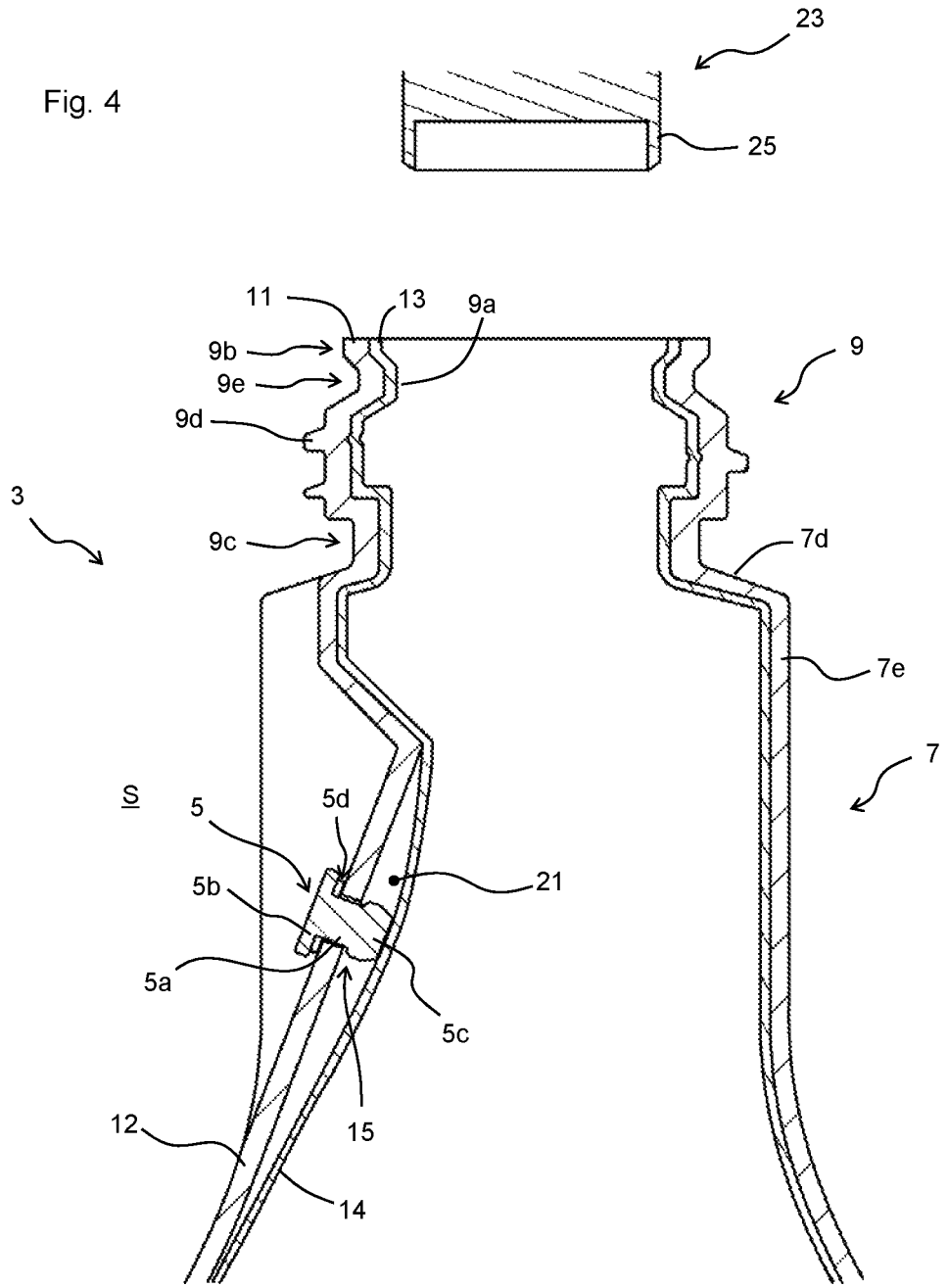
FIG. 4 is an enlarged view of a region including a mouth 9 in FIG. 3.

As illustrated in FIG. 4, the mouth 9 is equipped with external threads 9*d*. To the external threads 9*d*, a cap, a pump, or the like having internal threads is mounted. FIG. 4 partially illustrates a cap 23 having an inner ring 25. The inner ring 25 has an outer diameter approximately same as an inner diameter of the mouth 9. An outer surface of the inner ring 25 abuts on an abutment surface 9*a* of the mouth 9, thereby preventing leakage of the contents. In the present embodiment, the mouth 9 is equipped with an enlarged diameter portion 9*b* at the end. The enlarged diameter portion 9*b* has an inner diameter greater than the inner diameter in an abutment portion 9*e*, and thus the outer surface of the inner ring 25 does not make contact with the enlarged diameter portion 9*b*. When the mouth 9 does not have the enlarged diameter portion 9*b*, a defect sometimes occurs in which the inner ring 25 enters between the outer layer 11 and the inner layer 13 in the case where the mouth 9 has an even slightly smaller inner diameter due to variations in manufacturing. In contrast, when the mouth 9 has the enlarged diameter portion 9*b*, such defect does not occur even in the case where the mouth 9 has a slightly varied inner diameter.

The mouth 9 is also provided with an inner layer support portion 9*c* to inhibit slip down of the inner layer 13 in a position closer to the storage portion 7 than the abutment portion 9*e*. The inner layer support portion 9*c* is formed by providing a narrow part in the mouth 9. Even when the mouth 9 is equipped with the enlarged diameter portion 9*b*, the inner layer 13 sometimes delaminates from the outer layer 11 due to friction between the inner ring 25 and the inner layer 13. In the present embodiment, even in such case, the inner layer support portion 9*c* inhibits slip down of the inner layer 13, and thus it is possible to inhibit falling out of the inner bag 14 in the outer shell 12.

The storage portion 7 includes, in order from the mouth 9 side, a shoulder 7*d*, a small diameter body 7*e*, and a large diameter body 7*g*. The small diameter body 7*e* and the large diameter body 7*g* are approximately cylindrical, and the large diameter body 7*g* has a cross sectional area greater than that of the small diameter body 7*e*. The shoulder 7*d* is an area connecting the mouth 9 to the small diameter body 7*e*, and an enlarged diameter portion 7*f* is an area connecting the small diameter body 7*e* to the large diameter body 7*g*.

The small diameter body 7*e* includes a valve member mounting recess 7*a* composed of an inclined plane, and the recess 7*a* includes a fresh air inlet 15. The fresh air inlet 15 is a through hole provided only in the outer shell 12 and communicates an external space S of the container body 3 with an intermediate space 21 between the outer shell 12 and the inner bag 14. To the fresh air inlet 15 in the present embodiment, a valve member is mounted to regulate entrance and exit of air between the intermediate space 21 and the external space S. The recess 7*a* is provided to avoid interference between the valve member 5 and a shrink film in covering the storage portion 7 with the shrink film. In addition, not to tightly close the recess 7*a* with the shrink film, an air communication groove 7*b* is provided extending from the recess 7*a* toward the mouth 9.

Figure 1A:
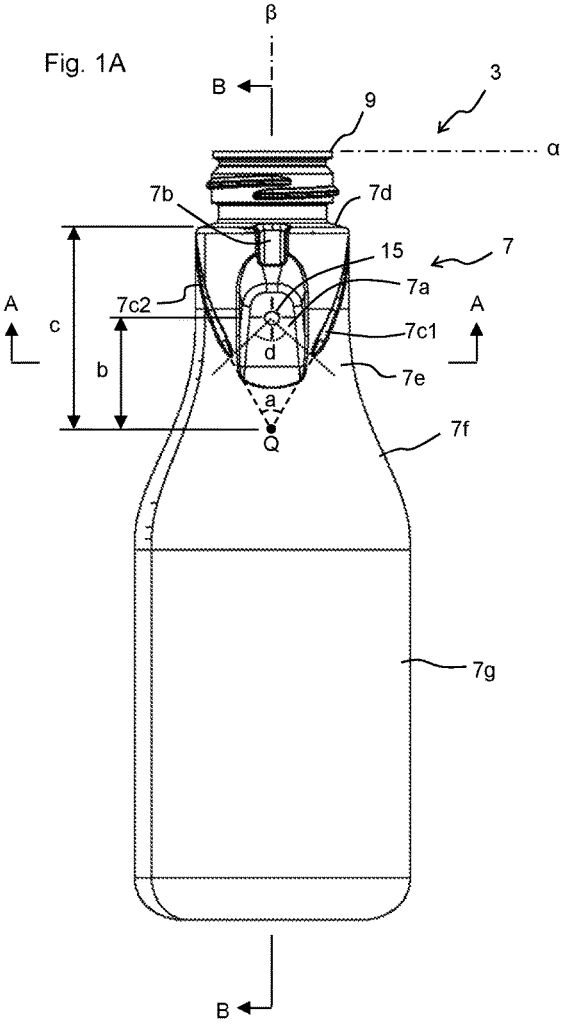
FIGS. 1A-1B illustrate the delaminatable container 1 in a first embodiment of the present invention, where

The small diameter body 7*e* also includes first and second grooved ribs 7*c*1 and 7*c*2 to sandwich the fresh air inlet 15. The grooved ribs 7*c*1 and 7*c*2 are provided to sandwich the fresh air inlet 15 (more specifically, recess 7*a*) from both circumferential sides. The grooved ribs 7*c*1 and 7*c*2 are formed to extend inclined circumferentially away from the fresh air inlet 15 toward the mouth 9. That is, the grooved ribs 7*c*1 and 7*c*2 are provided in an approximately V shape. The grooved ribs 7*c*1 and 7*c*2 are provided to reach the shoulder 7*d* from a position away from the mouth 9 further from the fresh air inlet 15. The grooved ribs 7*c*1 and 7*c*2 are provided outside a region d extending at a central angle of 90 degrees downward from the fresh air inlet 15. The grooved ribs 7*c*1 and 7*c*2 are provided at an angle in a front view from 30 to 100 degrees (preferably from 45 to 80 degrees). The grooved ribs 7*c*1 and 7*c*2 are provided to have an intersection Q of extensions thereof and a center of the fresh air inlet 15 positioned at a distance b from 5 to 35 mm (preferably from 10 to 25 mm) in a front view. A distance c from the intersection Q to the shoulder 7*d* in a front view is from 20 to 60 mm (preferably from 30 to 45 mm). The ratio b/c is from 0.2 to 0.8 (preferably from 0.3 to 0.6). A front view herein means a diagram taken from the fresh air inlet 15 side, as illustrated in FIG. 1A, of a surface vertical to a surface a formed by the edge of the mouth 9 and vertical to a surface β through a central axis C of the mouth 9 and the center of the fresh air inlet 15. As illustrated in FIG. 2, the fresh air inlet 15 and the grooved ribs 7*c*1 and 7*c*2 are provided in an approximately same plane. The technical meaning of providing the grooved ribs 7*c*1 and 7*c*2 and the reason for forming the grooved ribs 7*c*1 and 7*c*2 as described above in the present embodiment are described later.

Figure 5A:
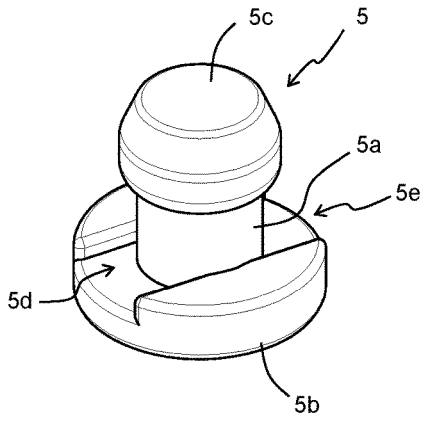
FIG. 5A is a perspective view of the valve member 5 and FIGS. 5B-5C are schematic cross-sectional views illustrating grooved ribs 7*c*1, 7*c*2 provided to form a bent portion 14*a* in an inner bag 14, causing a decrease in a force of the inner bag 14 to press the valve member 5 against an outer shell 12.
Figure 5B:
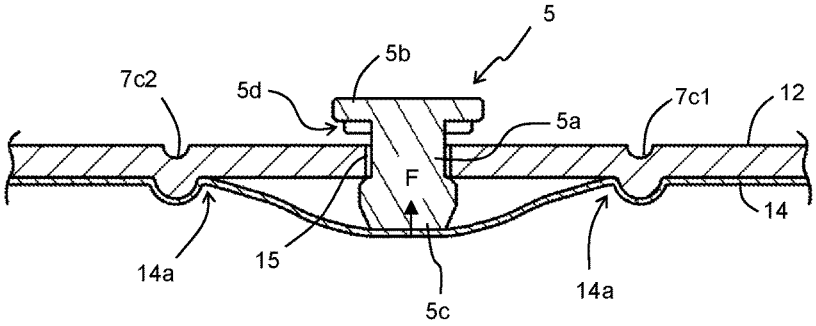
Figure 5C:
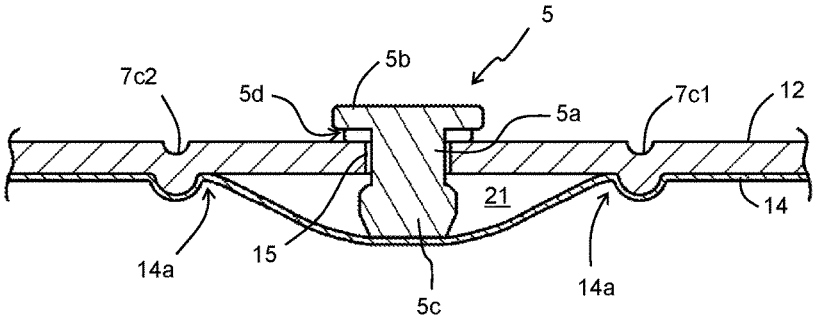

As illustrated in FIGS. 4 to FIG. 5C, The valve member 5 is provided with an axis 5*a* disposed in the fresh air inlet 15, a lid 5*c* provided on the intermediate space 21 side of the axis 5*a* and having a cross-sectional area greater than that of the axis 5*a*, and a locking portion 5*b* provided on the external space S side of the axis 5*a* and preventing entrance of the valve member 5 to the intermediate space 21. The valve member 5 is mounted to the container body 3 by inserting the lid 5*c* into the intermediate space 21 while the lid 5*c* presses and expands the fresh air inlet 15. The lid 5*c*, therefore, preferably has an end in a tapered shape. Since such valve member 5 can be mounted only by pressing the lid 5*c* from outside the container body 3 into the intermediate space 21, it is excellent in productivity.

The lid 5*c* is configured to substantially close the fresh air inlet 15 when the outer shell 12 is compressed and shaped to have a smaller cross-sectional area as coming closer to the axis 5*a*. The locking portion 5*b* is configured to be capable of introducing air in the intermediate space 21 when the outer shell 12 is restored after compression. When the outer shell 12 is compressed, the pressure in the intermediate space 21 becomes higher than external pressure and the air in the intermediate space 21 leaks outside from the fresh air inlet 15. The pressure difference and the air flow cause the lid 5*c* to move toward the fresh air inlet 15 to, as illustrated in FIG. 5B, close the fresh air inlet 15 by the lid 5*c*. Since the lid 5*c* has a shape with a smaller cross-sectional area as coming closer to the axis 5*a*, the lid 5*c* readily fits into the fresh air inlet 15 to close the fresh air inlet 15.

When the outer shell 12 is further compressed in this state, the pressure in the intermediate space 21 increases, and as a result, the inner bag 14 is compressed to discharge the contents in the inner bag 14. When the compressive force to the outer shell 12 is released, the outer shell 12 attempts to restore its shape by the elasticity of its own. At this point, as illustrated in FIG. 5C, the lid 5*c* goes away from the fresh air inlet 15 to release the closure of the fresh air inlet 15 and introduce fresh air into the intermediate space 21. Not to close the fresh air inlet 15 by the locking portion 5*b*, the locking portion 5*b* is provided with a flow passage 5*d* to allow introduction of fresh air into the intermediate space 21 through the flow passage 5*d* and the fresh air inlet 15 even when the locking portion 5*b* abuts on the outer shell 12.

With reference to FIGS. 5B-5C and FIGS. 6A-6B, the technical meaning of providing the grooved ribs 7*c*1 and 7*c*2 is described below.

Figure 6A:
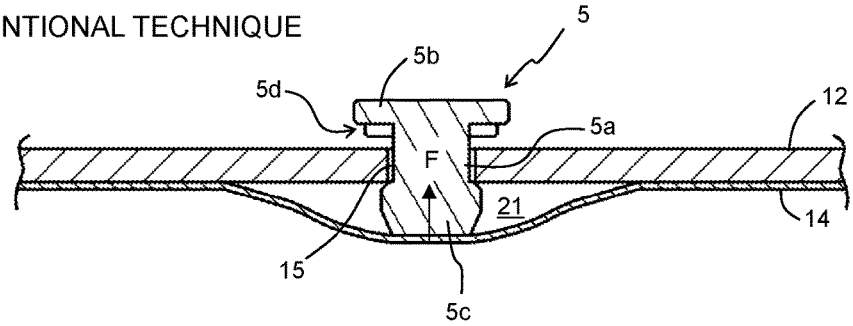
FIGS. 6A-6B are schematic cross-sectional views illustrating a problem, in a conventional technique, of the inner bag 14 pressing the valve member 5 against the outer shell 12.
Figure 6B:
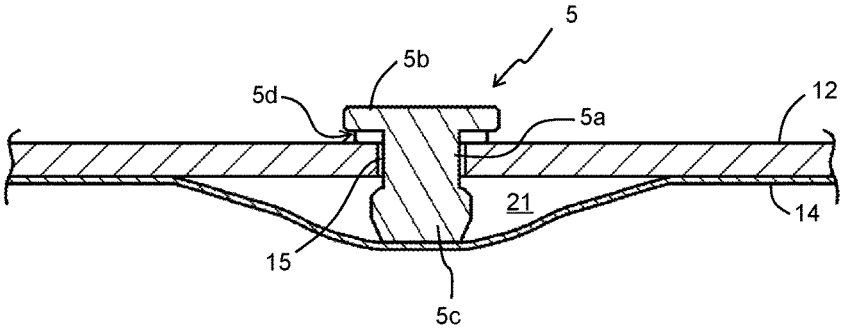

First, with reference to FIGS. 6A-6B, problems of conventional delaminatable containers are described. As illustrated in FIG. 6A, at the first discharge of the contents, the inner bag 14 is inflated by the contents to be in a state where the inner bag 14 makes contact with the lid 5*c* of the valve member 5. When the compressive force is then released after the contents in the inner bag 14 are discharged by compressing the outer shell 12 and the inner bag 14, the outer shell 12 attempts to go away from the lid 5*c* to restore its original shape by the elasticity of its own. Since the inner bag 14 also attempts to restore its original shape by the elasticity of its own, a force F in a direction of pressing the lid 5*c* against the outer shell 12 is applied to the lid 5*c* by the inner bag 14. When the inner bag 14 has sufficiently low rigidity, a gap is readily formed between the outer shell 12 and the lid 5*c* and the outer shell 12 immediately restores its original shape. In contrast, when the inner bag 14 has increased rigidity, the force F increases and the lid 5*c* is firmly pressed against the outer shell 12. In this state, a gap is not readily formed between the outer shell 12 and the lid 5*c* and the outer shell 12 has poorer restorability.

To solve such problems in the present embodiment, as illustrated in FIGS. 5B-5C, the grooved ribs 7*c*1 and 7*c*2 are provided to sandwich the fresh air inlet 15. As illustrated in FIG. 5B, a bent portion 14*a* is formed at the edge of the grooved ribs 7*c*1 and 7*c*2 and the inner bag 14 is bent at the bent portion 14*a* to be deformed inside the container, thereby reducing a force in a direction of inflating the inner bag 14 outside the container. The force F in the direction of pressing the lid 5*c* against the outer shell 12 by the inner bag 14 is thus less than that in the conventional technique illustrated in FIGS. 6A-6B. A gap is readily formed between the outer shell 12 and the lid 5*c* after the first discharge of the contents, and the outer shell 12 immediately restores its original shape.

Figure 1B:
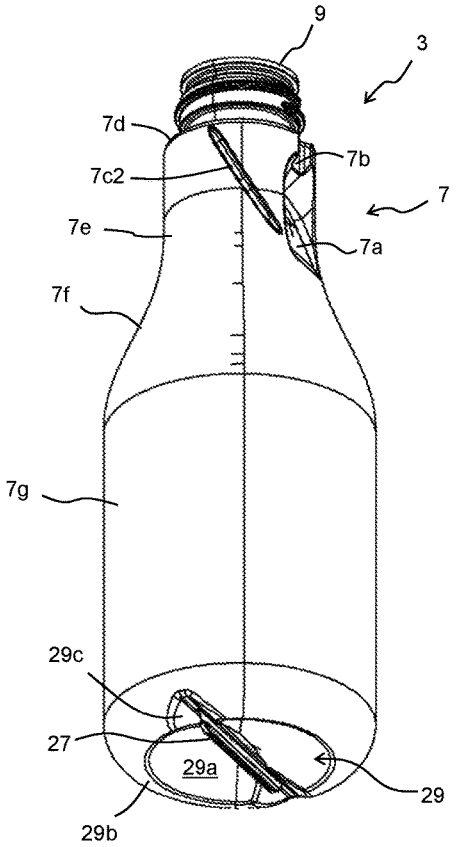

The reason for forming the grooved ribs 7*c*1 and 7*c*2 as illustrated in FIGS. 1A-1B in the present embodiment is described as follows. In search of a form to facilitate deformation of the inner bag 14 inside the container, the present inventors inserted a rod into the fresh air inlet 15 to try pressing the inner bag 14 inside the container. It was found that approximately V shaped creases were formed extending inclined circumferentially away from the fresh air inlet 15 toward the mouth 9. They then had an idea of possibly allowing more smooth deflation of the inner bag 14 by providing the grooved ribs 7*c*1 and 7*c*2 in advance in the positions where the creases were formed and provided the grooved ribs 7*c*1 and 7*c*2 in the positions illustrated in FIGS. 1A-1B. A large number of Example samples of a 360 mL container with the grooved ribs 7*c*1 and 7*c*2 in these positions and Comparative Example samples of a 360 mL container without the grooved ribs 7*c*1 and 7*c*2 were actually fabricated to measure time until the outer shell 12 restored its shape after 20 mL of the contents was first discharged from the fully filled state. All Example samples had the outer shell restored its shape within 7 seconds, whereas half or more of Comparative Example samples had the outer shell not restored its shape even after 60 seconds. The marked improvement in restorability of the outer shell 12 by providing the grooved ribs 7*c*1 and 7*c*2 was thus experimentally verified.

Figure 7A:
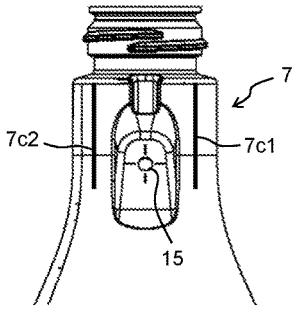
FIGS. 7A-7G are front views illustrating various modifications of the grooved ribs.
Figure 7B:
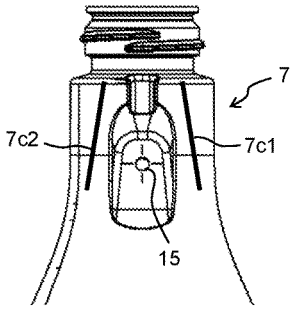
Figure 7C:
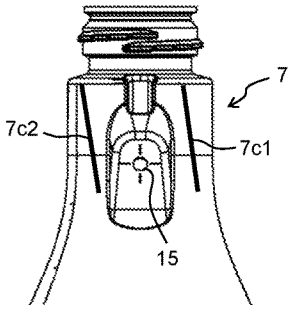
Figure 7D:
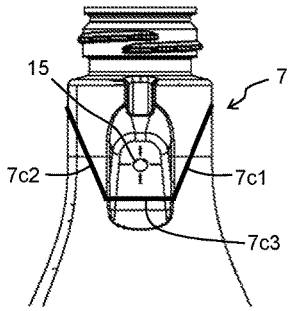
Figure 7E:
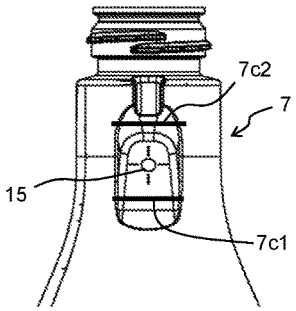
Figure 7F:
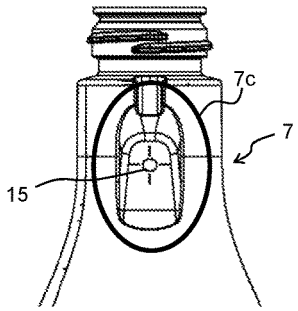
Figure 7G:
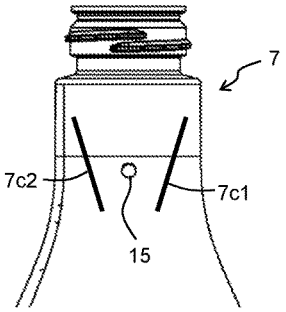

Note that, even if grooved ribs in a form other than the form illustrated in FIGS. 1A-1B are provided, an effect of reducing the force F is obtained by the action described above because a bent portion 14*a* is formed in the inner bag 14. FIGS. 7A-7G illustrate various modifications in the form of the grooved ribs. In FIG. 7A, the grooved ribs 7*c*1 and 7*c*2 are arranged in approximately parallel. In FIG. 7B, the grooved ribs are formed to extend inclined circumferentially toward the fresh air inlet 15. In FIG. 7C, the grooved ribs 7*c*1 and 7*c*2 are asymmetrical. In FIG. 7D, the grooved ribs 7*c*1 and 7*c*2 are connected by a grooved rib 7*c*3. In FIG. 7E, the grooved ribs 7*c*1 and 7*c*2 are provided to sandwich the fresh air inlet 15 from both vertical sides. In FIG. 7F, an oval grooved rib 7*c* is provided to surround the fresh air inlet 15. In FIG. 7G, the grooved ribs 7*c*1 and 7*c*2 are provided to sandwich the fresh air inlet 15 formed in a storage portion of a container not having the recess 7*a*. The cross section of the grooved ribs is not limited to a semicircular shape and may be in another shape as long as the bent portion 14*a* is formed. The grooved ribs are preferably formed to have a distance between the edge of the fresh air inlet 15 and a point of the grooved ribs closest to the fresh air inlet 15 from 3 to 30 mm (preferably from 5 to 20 mm). This is because the effect of reducing the force F is particularly large in this range.

In the present embodiment, as illustrated in FIG. 3, a distance L2 from the container central axis C to a container inner surface in the large diameter body 7*g* is 1.5 (preferably 1.6, 1.7, 1.8, 1.9, or 2.0) or more times a distance L1 from the container central axis C to a container inner surface in the small diameter body 7*e*. The delaminatable container 1 in the present embodiment is formed by blow molding. A greater L2/L1 thus causes a smaller blow ratio in the small diameter body 7*e*, which is the area where the fresh air inlet 15 is formed, leading to a thicker thickness and higher rigidity of the inner bag 14 to increase the force to press the valve member 5 against the outer shell 12 by the inner bag 14. Accordingly, in the delaminatable container having L2/L1 of 1.5 or more, the effect by providing the grooved ribs is particularly large.

The present embodiment is configured to open and close the fresh air inlet 15 by the valve member 5, which moves in a gap between the valve member 5 and the edge of the fresh air inlet 15. Meanwhile, the valve member itself may be configured to have a through hole and an on-off valve, which acts to open and close the through hole, thereby opening and closing the fresh air inlet 15. When a valve member in such configuration is used, there is a problem that closure of the vent of the valve member by close contact of the inner bag 14 with the valve member sometimes interferes with introduction of fresh air. This problem is, just like the present embodiment, is solved by providing the grooved ribs to sandwich the fresh air inlet 15.

Figure 8A:
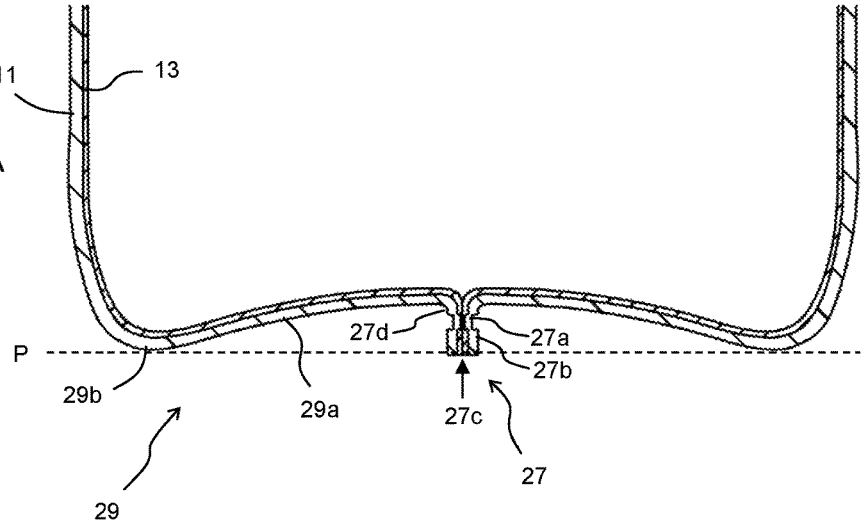
FIGS. 8A-8B are enlarged views of a region including a bottom surface 29 in FIG. 3, where
Figure 8B:
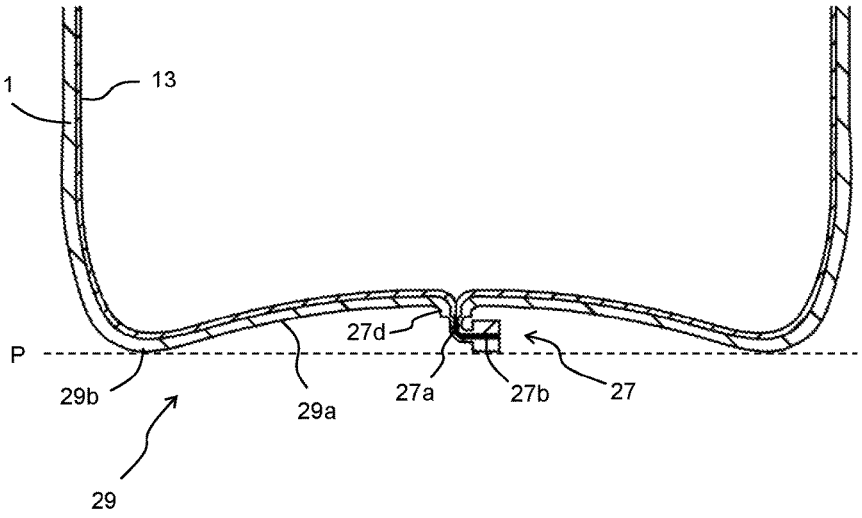

As illustrated in FIG. 1B, the storage portion 7 has a bottom surface 29 provided with a central recessed region 29*a* and a peripheral region 29*b* surrounding the central recessed region, and the central recessed region 29*a* includes a bottom seal protrusion 27 that protrudes from the bottom surface 29. As illustrated in FIGS. 8A-8B, the bottom seal protrusion 27 is a sealing portion of a laminated parison in blow molding using a cylindrical laminated parison provided with the outer layer 11 and the inner layer 13. The bottom seal protrusion 27 is provided with, in order from the bottom surface 29 side, a base portion 27*d*, a thinner portion 27*a*, and a thicker portion 27*b* having a thickness greater than that of the thinner portion 27*a*.

Immediately after blow molding, as illustrated in FIG. 8A, the bottom seal protrusion 27 is in a state of standing approximately vertically to a plane P defined by the peripheral region 29*b*. In this state, however, when impact is applied to the container, the inner layers 13 in a welded portion 27*c* are prone to be separated from each other and the impact resistance is insufficient. In the present embodiment, the thinner portion 27*a* is softened by blowing hot air on the bottom seal protrusion 27 after blow molding to bend the bottom seal protrusion 27, as illustrated in FIG. 8B, in the thinner portion 27*a*. The impact resistance of the bottom seal protrusion 27 is thus improved simply by a simple procedure of bending the bottom seal protrusion 27. In addition, as illustrated in FIG. 8B, the bottom seal protrusion 27 does not protrude from the plane P defined by the peripheral region 29*b* in a state of being bent. This prevents, when the delaminatable container 1 is stood, instability of the delaminatable container 1 due to the bottom seal protrusion 27 sticking out of the plane P.

The base portion 27*d* is provided on the bottom surface 29 side closer than the thinner portion 27*a* and is an area thicker than the thinner portion 27*a*. Although the base portion 27*d* does not have to be provided, the impact resistance of the bottom seal protrusion 27 is further improved by providing the thinner portion 27*a* on the base portion 27*d*.

As illustrated in FIG. 1(*b*), the concave region in the bottom surface 29 is provided across the entire bottom surface 29 in longitudinal directions of the bottom seal protrusion 27. That is, the central concave region 29*a* and the peripheral concave region 29*c* are connected. Such structure facilitates bending of the bottom seal protrusion 27.

The layer structure of the container body 3 is described below in further detail. The container body 3 is provided with the outer layer 11 and the inner layer 13.

The outer layer 11 is composed of, for example, low-density polyethylene, linear low-density polyethylene, high-density polyethylene, polypropylene, an ethylene-propylene copolymer, a mixture thereof, and the like. The outer layer 11 may have a multilayer structure. For example, it may have a structure where a reproduction layer has both sides sandwiched by polypropylene layers. Here, the reproduction layer refers to a layer using burrs produced while molding a container by recycling. The outer layer 11 is formed thicker than the inner layer 13 for better restorability.

In the present embodiment, the outer layer 11 includes a random copolymer layer containing a random copolymer of propylene and another monomer. The outer layer 11 may be a single layer of the random copolymer layer or may be a multilayer structure. For example, it may have a structure where a reproduction layer has both sides sandwiched by random copolymer layers. The outer layer 11 is composed of a random copolymer of specific composition to improve shape restorability, transparency, and heat resistance of the outer shell 12.

The random copolymer has a content of a monomer other than propylene of less than 50 mol % and preferably from 5 to 35 mol %. Specifically, this content is, for example, 5, 10, 15, 20, 25, and 30 mol % or it may be in a range between any two values exemplified here. The monomer to be copolymerized with propylene may be one that improves impact resistance of the random copolymer compared with a homopolymer of polypropylene, and ethylene is particularly preferred. In the case of a random copolymer of propylene and ethylene, the ethylene content is preferably from 5 to 30 mol %. Specifically, it is, for example, 5, 10, 15, 20, 25, and 30 mol % or it may be in a range between any two values exemplified here. The random copolymer preferably has a weight average molecular weight from 100 thousands to 500 thousands, and even more preferably from 100 thousands to 300 thousands. Specifically, the weight average molecular weight is, for example, 100 thousands, 150 thousands, 200 thousands, 250 thousands, 300 thousands, 350 thousands, 400 thousands, 450 thousands, and 500 thousands or it may be in a range between any two values exemplified here.

The random copolymer has a tensile modulus of elasticity preferably from 400 to 1600 MPa and more preferably from 1000 to 1600 MPa. This is because the shape restorability is particularly good with a tensile modulus of elasticity in such range. Specifically, the tensile modulus of elasticity is, for example, 400, 500, 600, 700, 800, 900, 1000, 1100, 1200, 1300, 1400, 1500, and 1600 Mpa or it may be in a range between any two values exemplified here.

Since an excessively hard container impairs feeling of using the container, the outer layer 11 may be composed by, for example, mixing a softening material, such as linear low-density polyethylene, to the random copolymer. Note that, in order not to severely interfere with effective properties of the random copolymer, the material to be mixed with the random copolymer is preferably mixed to be less than 50 weight % based on the entire mixture. For example, the outer layer 11 may be composed of a material in which the random copolymer is mixed with linear low-density polyethylene at a weight ratio of 85:15.

Figure 9:
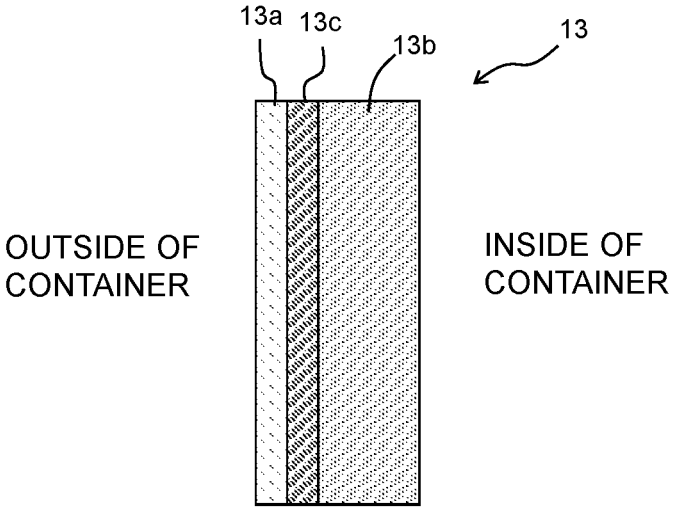
FIG. 9 is a cross-sectional view illustrating a layer structure of the inner layer 13.

As illustrated in FIG. 9, the inner layer 13 includes, in order from the container outer surface side, an outside layer 13*a*, an adhesion layer 13*c*, and an inside layer 13*b*. The outside layer 13*a* is a layer on the container outer surface side from the adhesion layer 13*c* in the inner layer 13 and may be a single layer or a multilayer. The inside layer 13*b* is a layer on a container inner surface side from the adhesion layer 13*c* in the inner layer 13 and may be a single layer or a multilayer. The adhesion layer 13*c* is a layer adhering the outside layer 13*a* to the inside layer 13*b* and may be a single layer or a multilayer. The adhesion layer 13*c* may be omitted.

The outside layer 13*a* includes an EVOH layer and is preferably a single layer of an EVOH layer. The EVOH layer thus provided allows improvement in barrier properties and delamination properties from the outer layer 11.

The EVOH layer is a layer containing an ethylene-vinyl alcohol copolymer (EVOH) resin and is obtained by hydrolysis of a copolymer of ethylene and vinyl acetate. The EVOH resin has an ethylene content, for example, from 25 to 50 mol %, and from the perspective of oxygen barrier properties, it is preferably 32 mol % or less. Although not particularly defined, the lower limit of the ethylene content is preferably 25 mol % or more because the flexibility of the EVOH layer is prone to decrease when the ethylene content is less. The EVOH layer preferably contains an oxygen absorbent. The content of an oxygen absorbent in the EVOH layer further improves the oxygen barrier properties of the EVOH layer. The EVOH layer preferably has a thickness from 10 to 50 μm and more preferably from 20 to 40 μm. Specifically, the thickness is, for example, 20, 25, 30, 35, 40, 45, or 50 μm or it may be in a range between any two values exemplified here. A too thin EVOH layer causes insufficient exhibition of the oxygen barrier properties, whereas a too thick EVOH layer causes an increase in rigidity of the inner layer 13 and difficulty in deflation of the inner bag 14.

The EVOH resin preferably has a melting point higher than the melting point of the resin (e.g., random copolymer) contained in the outer layer 11. The fresh air inlet 15 is preferably formed in the outer layer 11 using a thermal perforator. The EVOH resin has a melting point higher than the melting point of the resin contained in the outer layer 11, the inlet can be prevented from reaching the inner layer 13 in formation of the fresh air inlet 15 in the outer layer 11. From this perspective, a greater difference of (Melting Point of EVOH)—(Melting Point of Random Copolymer Layer) is desired, and it is preferably 15° C. or more and particularly preferably 30° C. or more. The difference in melting points is, for example, from 5 to 50° C. Specifically, it is, for example, 5, 10, 15, 20, 25, 30, 35, 40, 45, and 50° C. or it may be in a range between any two values exemplified here.

The adhesion layer 13*c* is a layer having a function of adhering the outside layer 13*a* to the inside layer 13*b*, and it is, for example, a product of adding acid modified polyolefin (e.g., maleic anhydride modified polyethylene) with carboxyl groups introduced therein to polyolefin described above or an ethylene-vinyl acetate copolymer (EVA). An example of the adhesion layer 13*c* is a mixture of acid modified polyethylene with low-density polyethylene or linear low-density polyethylene. The adhesion layer 13*c* preferably has a thickness from 10 to 50 μm and more preferably from 20 to 40 μm. Specifically, the thickness is, for example, 20, 25, 30, 35, 40, 45, or 50 μm or it may be in a range between any two values exemplified here. A too thin adhesion layer 13*c* tends to cause insufficient adhesion of the outside layer 13*a* to the inside layer 13*b*, whereas a too thick adhesion layer 13*c* causes an increase in rigidity of the inner layer 13 and difficulty in deflation of the inner bag 14.

The inside layer 13*b* contains, for example, polyolefin, such as low-density polyethylene, linear low-density polyethylene, high-density polyethylene, polypropylene, an ethylene-propylene copolymer, and a mixture thereof, and preferably low-density polyethylene or linear low-density polyethylene. The inside layer 13*b* preferably has a thickness from 60 to 200 μm and more preferably from 70 to 150 μm. Specifically, the thickness is, for example, 60, 65, 70, 75, 80, 85, 90, 95, 100, 105, 110, 115, 120, 125, 130, 135, 140, 145, 150, 155, 160, 165, 170, 175, 180, 185, 190, 195, or 200 μm or it may be in a range between any two values exemplified here. A too thin inside layer 13*b* causes insufficient inhibition of degradation of the EVOH layer, whereas a too thick inside layer 13*b* causes an excessive increase in rigidity of the inner layer 13 and difficulty in deflation of the inner bag 14. The inside layer 13*b* preferably has a bending modulus of elasticity of 250 MPa or less and the bending modulus of elasticity is preferably 240, 230, 220, 210, 200, 190, 180, 170, 160, 150, or 140 MPa or less. The inside layer 13*b* having a too large bending modulus of elasticity causes an excessive increase in rigidity of the inner layer 13 and difficulty in deflation of the inner bag 14. The resin contained in the inner surface layer 13*b* preferably has a tensile modulus of elasticity from 50 to 300 MPa and more preferably from 70 to 200 MPa. This is because the inner surface layer 13*b* is particularly flexible when the tensile modulus of elasticity is in such range. Specifically, the tensile modulus of elasticity is, for example, specifically for example, 50, 100, 150, 200, 250, and 300 Mpa or it may be in a range between any two values exemplified here.

The value of (Thickness of the Inside Layer 13*b*/Thickness of the EVOH Layer) is preferably from 1.1 to 5 and more preferably from 1.5 to 4. Specifically, the value is, for example, 1.1, 1.5, 2, 2.5, 3, 3.5, 4, 4.5, or 5 or it may be in a range between any two values exemplified here. The value within this numerical range results in good oxygen barrier properties and good shrinkability of the inner layer.

The entire inner layer 13 preferably has a thickness from 100 to 250 μm and more preferably from 120 to 200 μm. Specifically, the thickness is, for example, 100, 110, 120, 130, 140, 150, 160, 170, 180, 190, 200, 210, 220, 230, 240, or 250 μm or it may be in a range between any two values exemplified here. The entire inner layer 13 having a too thin thickness causes insufficient oxygen barrier properties or insufficient inhibition of degradation of the EVOH layer, whereas the entire inner layer 13 having a too thick thickness causes an excessive increase in rigidity of the inner layer 13 and difficulty in deflation of the inner bag 14. The entire inner layer 13 preferably has a tensile modulus of elasticity of 750 MPa or less. In this case, the inner layer 13 has low rigidity and the inner bag 14 is readily deflated. The entire inner layer 13 preferably has a tensile modulus of elasticity of 725 MPa or less and more preferably 700 MPa or less.

With reference to FIGS. 14A-15C, a description is then given to a method of manufacturing the delaminatable container 1 in the present embodiment.

First, the container body 3 of configuration illustrated in FIGS. 1A-1B is manufactured by blow molding or the like, and the fresh air inlet 15 is formed in the outer shell 12. The valve member 5 is then mounted to the fresh air inlet 15. The cap 23 is then manufactured by injection molding or the like. After the inner bag 14 of the container body 3 is filled with the contents, as illustrated in FIGS. 14A-14B, the cap 23 is then mounted to the mouth 9.

Figures 14A, 14B, 14C:
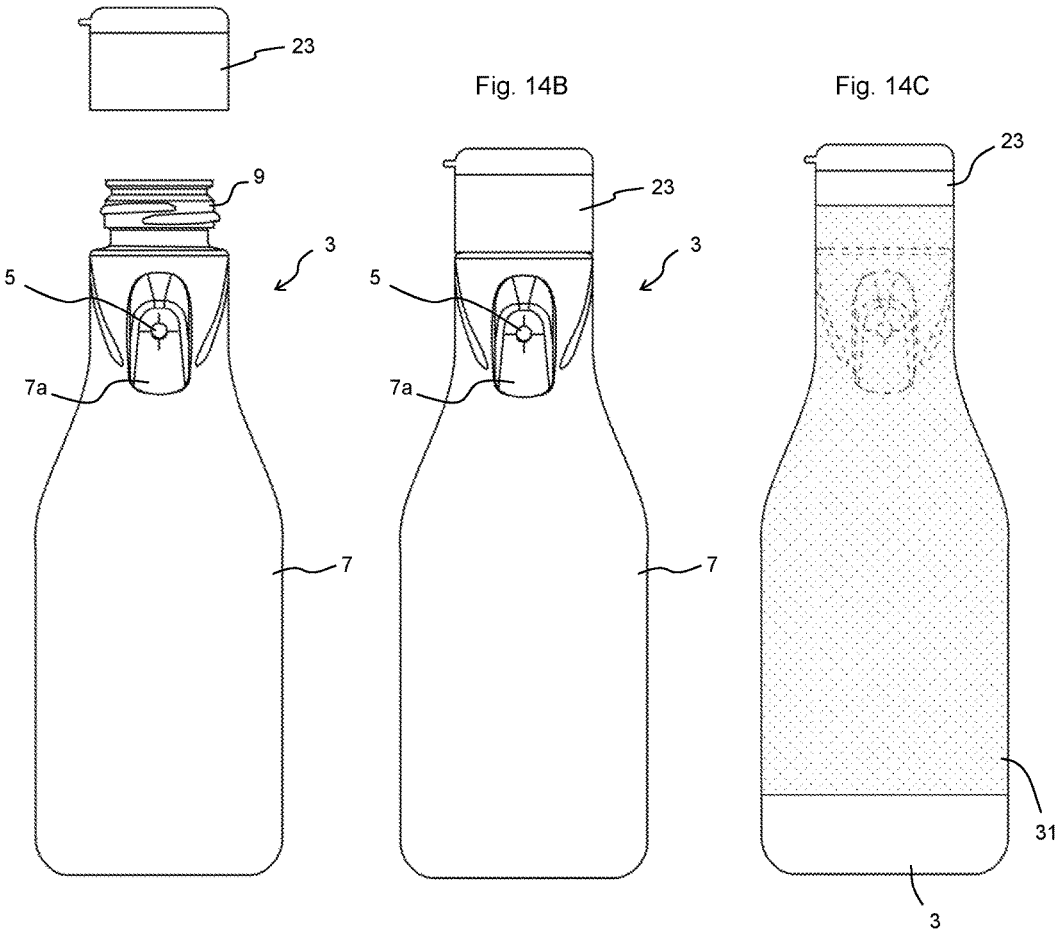
FIG. 14A is a front view of a state before mounting a cap 23 to a container body 3.
FIG. 14B is a front view of a state after mounting the cap 23 to the container body 3.
FIG. 14C is a front view illustrating a state of a shrink film 31 mounted to the container body 3 and the cap 23 that are in the state of FIG. 14B.
Figure 15A:
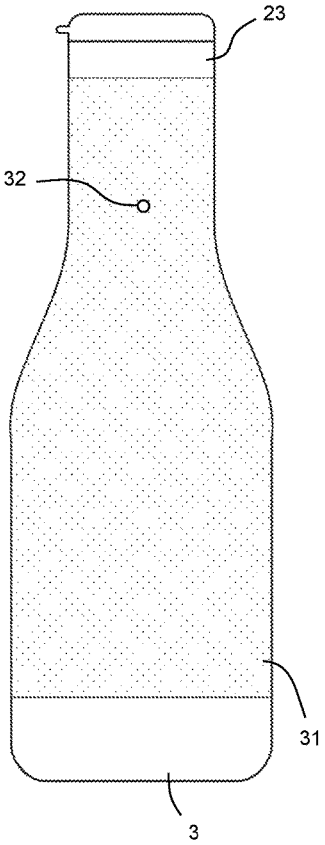
FIGS. 15A-15C are front views illustrating the shrink film 31 provided with, respectively as a vent, a pinhole 32, circumferential perforations 33, and axial perforations 34.
Figure 15B:
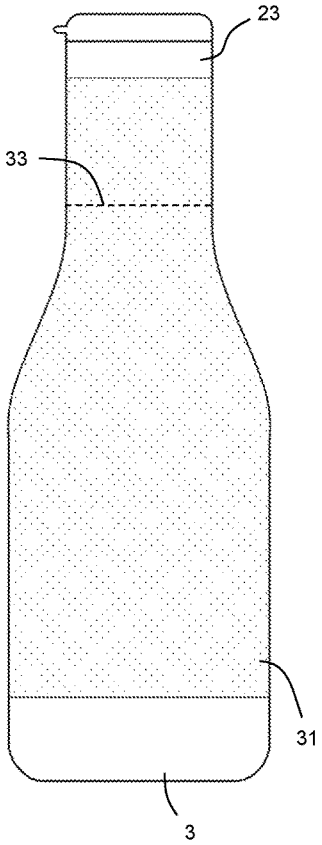
Figure 15C:
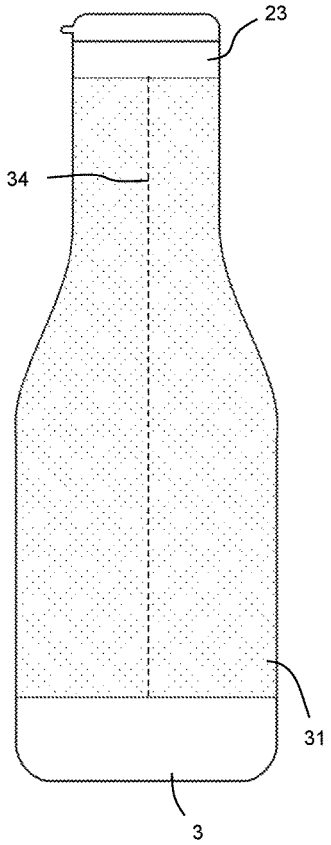

As illustrated in FIG. 14C, the container body 3 and the cap 23 are then covered with a tubular shrink film 31, and the shrink film 31 is heated to shrink the shrink film 31 for close contact of the shrink film 31 with the container body 3 and the cap 23. Although the delaminatable container 1 is assumed to be used without removing the cap 23 to prevent entrance of fresh air into the inner bag 14, a consumer not familiar with the delaminatable container 1 sometimes tries to remove the cap 23. The present embodiment makes it difficult to remove the cap 23 by mounting the shrink film 31 to closely contact with both the container body 3 and the cap 23. Note that, such configuration causes a region from the container body 3 to the cap 23 covered with the shrink film 31, resulting in a new problem of not sufficiently introducing fresh air into the fresh air inlet 15. In the present embodiment, a vent is provided in the shrink film 31 to facilitate introduction of fresh air into the fresh air inlet 15. The vent is not limited in shape, arrangement, size, the number, and the like as long as the configuration enables introduction of fresh air into the fresh air inlet 15. In one example, as illustrated in FIG. 15A, the vent is composed of a pinhole 32. In another example, as illustrated in FIG. 15B, the vent is composed of a large number of pores (so-called perforations) 33 provided along the circumference of the tubular shrink film 31. Such configuration has an advantage of introducing fresh air into the fresh air inlet 15 regardless of a relative circumferential position of the shrink film 31 to the container body 3. In still another example, as illustrated in FIG. 15C, the vent is composed of a large number of pores (so-called perforations) 34 provided along the axis of the shrink film 31. In this case, there is an advantage of readily removing the shrink film 31 from the container body 3 by tearing the shrink film 31 along the perforations 34 to make the tubular shrink film 31 into a sheet shape. The shrink film 31 may be provided with both the perforations 33 and the perforations 34.

The present embodiment may be carried out in the following modes.

Although covering part of the container body 3 and part of the cap 23 in the above embodiment, the shrink film 31 may be provided to cover the entire container body 3 and/or cap 23. It may be provided to cover only the storage portion 7 of the container body 3 not covering the cap 23.

Although the valve member 5 is mounted to the fresh air inlet 15 in the above embodiment, the valve member 5 is not essential, and when no valve member 5 is provided, the pressure in the intermediate space 21 may be increased by closing the fresh air inlet 15 or the vent of the shrink film 31 with a finger for discharge of the contents.

Although the fresh air inlet 15 is provided in the valve member mounting recess 7*a* in the above embodiment, the valve member mounting recess 7*a* is not essential and the fresh air inlet 15 may be provided in a region that is not recessed. Although the valve member mounting recess 7*a* is preferably provided to avoid interference between the valve member 5 and the shrink film 31 for opening and closing the fresh air inlet 15 by moving the entire valve member 5 as in the above embodiment, there is no trouble in the function without the valve member mounting recess 7*a* when the valve member 5 is not mounted or a valve member 5 with a built-in valve function is used.

2. Second Embodiment

With reference to FIGS. 10A-12C, the second embodiment of the present invention is described. The present embodiment is similar to the first embodiment and mainly differs in that the grooved ribs 7*c* have a different shape. The following description is mainly given to the differences.

Figure 10A:
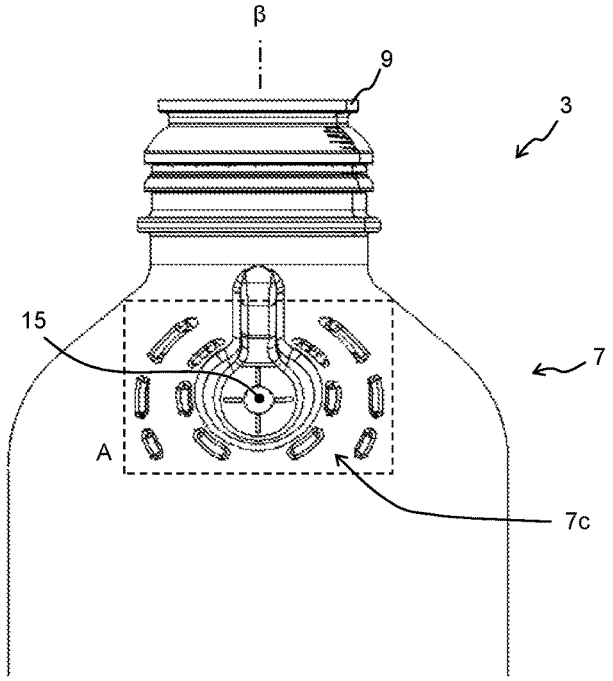
FIGS. 10A-10B illustrate a structure of a container body 3 of a delaminatable container 1 in a second embodiment of the present invention, where
Figure 10B:
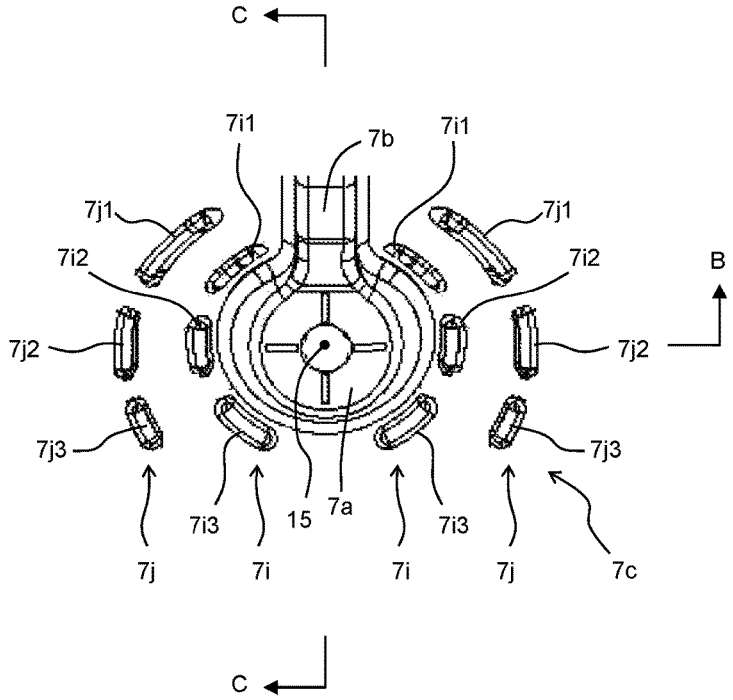

In the present embodiment, as illustrated in FIGS. 10A-10B, the grooved ribs 7*c* are provided to arcuately (preferably circularly) surround the fresh air inlet 15. The grooved ribs 7*c* include inside arcs 7*i* and outside arcs 7*j*. The arcs 7*i* and 7*j* are arranged separated from each other in a direction away from the fresh air inlet 15 (i.e., radially from the fresh air inlet 15 as the center). The inside arcs 7*i* are arranged in positions closer to the fresh air inlet from the outside arcs 7*j*. The arcs 7*i* and 7*j* are arranged approximately concentrically, and the center of circles passing through the respective arcs 7*i* and 7*j* approximately coincides with the center of the fresh air inlet. As illustrated in FIGS. 11A-11B, at the respective edge of the arcs 7*i* and 7*j*, the bent portions 14*a* may be formed in the inner bag 14. The arcs 7*i* and 7*j* are provided to exhibit an effect of reducing the force in a direction of inflating the inner bag 14 outside the container. A plurality of arcs 7*i* and 7*j* are provided to allow formation of the bent portions 14*a* in a plurality of areas to reduce the force in a direction of inflating the inner bag 14 in each bent portion 14*a*. The grooved ribs 7*c* may include at least one arc group and either one of the arcs 7*i* and 7*j* may be omitted.

The arcs 7*i* and 7*j* are provided respectively plane symmetric to a surface β (C-C cross section in FIG. 10B) through the center of the mouth 9 and the center of the fresh air inlet 15. Specifically, the arcs 7*i* and 7*j* includes a plurality of grooves 7*i*1-7*i*3 and 7*j*1-7*j*3, respectively, separated from each other in the circumferential direction of the arcs 7*i* and 7*j* on each of the left and right of the surface β. Although the arcs 7*i* and 7*j* may be configured to include one groove on each of the left and right of the surface β, the arcs 7*i* and 7*j* respectively composed of the plurality of grooves 7*i*1-7*i*3 and 7*j*1-7*j*3 have an advantage of stably forming the bent portions 14*a* in the inner bag 14.

FIGS. 11A-11B illustrate a state after performing, following formation of the container body 3, preliminary delamination to delaminate the inner bag 14 from the outer shell 12 before storage of the contents in the storage portion 7 and then filling the storage portion 7 with the contents. FIG. 11A illustrates a state after preliminary delamination and content filling to form the bent portions 14*a* in the inside arcs 7*i*, and FIG. 11B illustrates a state after preliminary delamination and content filling to form the bent portions 14*a* in the outside arcs 7*j*. In FIGS. 11A-11B, the inner bag 14 does not contact with the valve member 5. The inner bag 14 thus does not press the valve member 5 against the outer shell 12 for closure of the fresh air inlet 15, and fresh air is immediately introduced into the intermediate space 21 through the fresh air inlet 15 after discharging the contents to smoothly restore the shape of the outer shell 12. The preliminary delamination and content filling may be performed to make the inner bag 14 contact with the valve member 5. Even in this case, the force in a direction of inflating the inner bag 14 outside the container is reduced and the effect of improving the restorability of the outer shell 12 is exhibited.

Figure 12A:
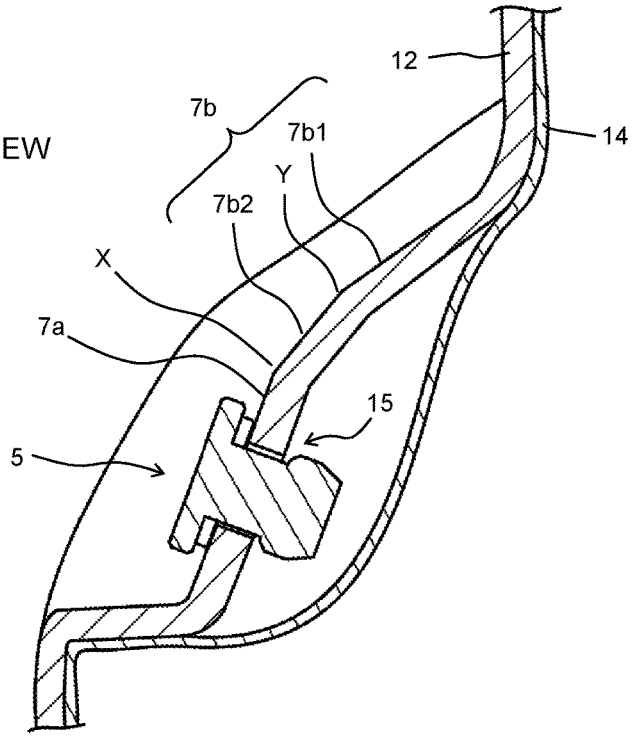
FIG. 12A illustrates a C-C cross section in FIG. 10B in a state of mounting the valve member 5 to the container body 3 in FIGS. 10A-10B and FIGS. 12B-12C are schematic views illustrating an angle between a bottom surface of a recess 7*a* and a bottom surface of a groove 7*b*, where
Figure 12B:
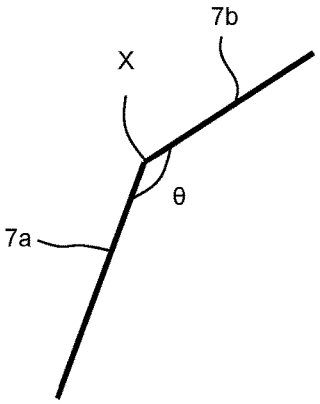
FIG. 12B illustrates a state of having no bend Y in the groove 7*b* and FIG. 12C illustrates a state of having the bend in the groove 7*b*.
Figure 12C:
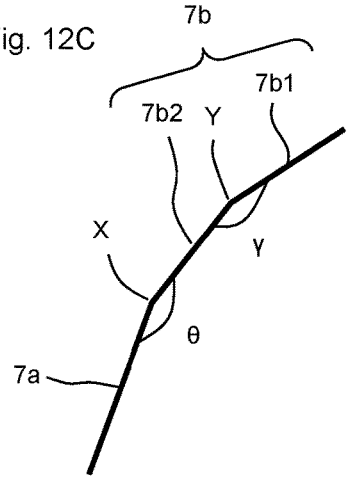

The storage portion 7 includes the valve member mounting recess 7*a* composed of an inclined plane, and the recess 7*a* includes the fresh air inlet 15. Not to tightly close the recess 7*a* with the shrink film, the air communication groove 7*b* is provided extending from the recess 7*a* toward the mouth 9. As illustrated in FIG. 12B, when an angle θ between the bottom surface of the recess 7*a* and the bottom surface of the groove 7*b* is less than 150 degrees (preferably less than 145 degrees), a bent portion sometimes happens to be formed in the inner bag 14 in a connection area X between the bottom surface of the recess 7*a* and the bottom surface of the groove 7*b*, causing the inner bag 14 not readily separated from the outer shell 12 in the groove 7*b*. In the present embodiment, as illustrated in FIG. 12C, by constituting the bottom surface of the groove 7*b* by first and second areas 7*b*1 and 7*b*2 bent at a bend Y, the angle θ between the bottom surface of the recess 7*a* and the bottom surface of the groove 7*b* is 150 degrees or more (preferably 155 degrees or more). An angle y between the first and second areas 7*b*1 and 7*b*2 is also 150 degrees or more (preferably 155 degrees or more). Such configuration has an advantage of immediately separating the inner bag 14 from the outer shell 12 in the groove 7*b* without forming a bent portion in the inner bag 14 in the connection area X and the bend Y.

3. Third Embodiment

Figure 13A:
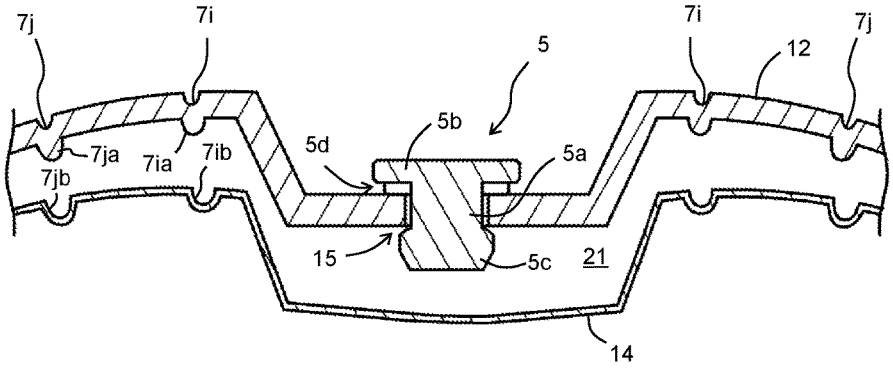
FIGS. 13A-13B are cross-sectional views of an area, corresponding to the B-B cross section in FIG. 10B, in a delaminatable container 1 in a third embodiment of the present invention, where
Figure 13B:
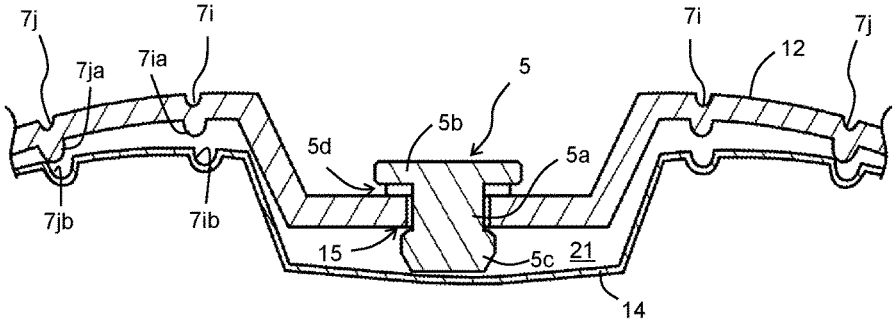

With reference to FIGS. 13A-13B, the third embodiment of the present invention is described. The present embodiment is similar to the second embodiment and mainly differs in a method of preliminarily delaminating the inner bag 14. The following description is mainly given to the differences.

In the second embodiment, as illustrated in FIGS. 11A-11B, the inner bag 14 is not delaminated from the outer shell 12 in the outside arcs 7*j*. In the present embodiment, as illustrated in FIG. 13A, preliminary delamination is performed to delaminate the inner bag 14 from the outer shell 12 in both the inside arcs 7*i* and the outside arcs 7*j*. The preliminary delamination may be performed by, for example, inserting a rod from the fresh air inlet 15 and pressing the inner bag 14 by the rod. FIG. 13A illustrates a state after the preliminary delamination, where in the arcs 7*i* and 7*j*, convexes 7*ia* and 7*ja* are provided on an inner surface of the outer shell 12 and concaves 7*ib* and 7*jb* are provided in an outer surface of the inner bag 14. The convex Tia and the concave 7*ib* are in a complementary shape, and the convex 7*ja* and the concave 7*jb* are in a complementary shape. A bent line is naturally formed in the inner bag 14 when the inner bag 14 is delaminated from the outer shell 12. Even when the inner bag 14 is filled with the contents and the inner bag 14 is pressed against the outer shell 12, the positions of the convexes 7*ia* and 7*ja*and the recess 7*a* concaves 7*ib* and 7*jb* are not shifted and the convexes 7*ia* and 7*ja* and the recess 7*a* concaves 7*ib* and 7*jb* do not fit. The state of separating the inner bag 14 from the outer shell 12 is thus maintained, and the force to press the valve member 5 against outside the container by the inner bag 14 does not work or the force is reduced.

Embodiment in Fourth Aspect of the Invention

4. Fourth Embodiment

With reference to FIGS. 16A-19C, the fourth embodiment of the present invention is described. The present embodiment mainly differs in that the container body 3 has a bottom 9 formed with an approximately linear pinch-off (bottom seal protrusion 27) and one adhesion strip 101 extending heightwise of a side wall is formed in a position of the side wall intersecting an extension of one end of the pinch-off. The following description is mainly given to the differences.

A container body 3 in the present embodiment has a shape different from that in the first to third embodiments, and the storage portion 7 includes a body portion 19 having an approximately constant cross section in a longitudinal direction of the storage portion 7 and a shoulder 17 connecting the body portion 19 to the mouth 9. A sealing portion of a laminated parison is formed linearly to the bottom surface 29 of the storage portion 7, and as a result, the inner layer 13 (inner bag 14) is fixed linearly in the bottom surface 29. This is important to fully use up the contents in combination with the adhesion strip 101.

The outer layer 11 (outer shell 12) and the inner layer 13 (inner bag 14) is configured to allow easy delamination from the outer layer 11 (outer shell 12). In the case of the delaminatable container 1 in the present embodiment, as illustrated in FIGS. 16A-17D, only one adhesion strip 101 is formed in the side wall to be configured not to delaminate the inner layer 13 (inner bag 14) from the outer layer 11 (outer shell 12) in this area.

The adhesion strip 101 is formed from a material capable of adhering the outer layer 11 (outer shell 12) to the inner layer 13 (inner bag 14) and is formed from, for example, adhesive polyolefin, various adhesives, or the like. Alternatively, it may be formed by heat welding or the like. The adhesion strip 101 may have an arbitrary width while the width is generally set at around several mm.

The adhesion strip 101 is formed in a position where the side wall and an extension of one end of the pinch-off intersect at the bottom surface, and the adhesion strip 101 is formed roughly across the overall height from the bottom surface to the mouth to raise the extension along the side wall.

Then, working principle of the delaminatable container 1 in this embodiment in use is described.

As illustrated in FIG. 18, the side of the outer shell 12 is held to be compressed in a tilted state of the delaminatable container 1 filled with the contents to discharge the contents. At this point, the delaminatable container 1 is tilted to have the adhesion strip 101 positioned downward. The cap 23 is accordingly assembled to the mouth to have a hinge h positioned approximately 180 opposite to the position to form the adhesion strip 101.

In the example illustrated in FIG. 18, different from the delaminatable container 1 illustrated in FIGS. 16A-17D, the fresh air inlet 15 and the valve member 5 are provided in the positions 180° opposite to the adhesion strip 101 in the circumferential direction of the container body [in the embodiment of FIGS. 16A-16B and FIGS. 17A-17D, the positions are rotated at 90° (perpendicularly positioned)]. Although fresh air is introduced into the fresh air inlet 15 in restoration of the outer shell 12, the introduced air is distributed to the space on both sides of the inner bag 14 fixed to the pinch-off by providing the fresh air inlet 15 and the valve member 5 in the positions illustrated in FIGS. 18A-18D, which are suitable positions to smoothly shrink the inner bag 14. The same mechanism applies to the case of providing the fresh air inlet 15 in the mouth 9.

At the start of use, as illustrated in FIG. 19A, there is substantially no gap between the inner bag 14 and the outer shell 12, and the compressive force applied to the outer shell 12 remains as the compressive force to the inner bag 14 to compress the inner bag 14 and discharge the contents.

The cap 23 has a built-in check valve, not shown, so that it is capable of delivering the contents in the inner bag 14 but not capable of taking fresh air in the inner bag 14. Therefore, when the compressive force applied to the outer shell 12 is removed after delivery of the contents, the outer shell 12 attempts to be back in the original shape by the restoring force of itself but the inner bag 14 remains deflated and only the outer shell 12 expands. Then, as illustrated in FIG. 18 and FIG. 19B, inside the intermediate space 21 between the inner bag 14 and the outer shell 12 is in a reduced pressure state to introduce fresh air in the intermediate space 21 through the fresh air inlet 15 formed in the outer shell 12. When the intermediate space 21 is in a reduced pressure state, the lid 5*c* is not pressed against the fresh air inlet 15 and thus it does not interfere with introduction of fresh air. Not to cause the locking portion 5*b* to interfere with introduction of fresh air even in a state where the locking portion 5*b* makes contact with the outer shell 12, the locking portion 5*b* is provided with an air passage securing mechanism, such as the projections and grooves.

Although it generally becomes difficult to discharge the remaining contents with a decrease in the contents, the delaminatable container 1 in the present embodiment has the inner bag 14 linearly fixed to the pinch-off of the bottom surface and also linearly fixed to the side wall by the adhesion strip 101. As illustrated in FIG. 19C, a space 102 with an approximately triangular cross section is thus formed along the adhesion strip 101.

Accordingly, even immediately before using up the contents, the space 102 is secured as a passage for the contents in a lower position of the delaminatable container 1, and the contents are immediately and smoothly discharged to outside through the passage until the end. As a result, it is possible to fully use up the contents.

EXAMPLES

Examples and Comparative Examples below are mainly related to the invention in the first aspect.

Comparative Example 1

A delaminatable container was produced, by blow molding, that has an outer layer containing a polypropylene layer (thickness of 500 μm), an inner layer containing an EVOH layer (thickness of 30 μm, Soarnol SF7503B produced by the Nippon Synthetic Chemical Industry Co., Ltd.), an adhesion layer (thickness of 30 μm, MODIC L522 produced by Mitsubishi Chemical Corp.), and a low-density polyethylene layer (thickness of 40 μm and bending modulus of elasticity of 340 MPa, Suntec F2206 produced by Asahi Kasei Chemicals Corp.) in order from the container outer surface side and has an internal capacity of 200 mL. The thickness of each layer was measured in the thinnest area in the delaminatable container.

Comparative Example 2

A delaminatable container was produced in the same manner as in Comparative Example 1 other than changing the thickness of the EVOH layer to 60 μm.

Comparative Example 3

A delaminatable container was produced in the same manner as in Comparative Example 1 other than changing the thickness of the low-density polyethylene layer to 80 μm.

Example 1

A delaminatable container was produced in the same manner as in Comparative Example 1 other than changing the thickness of the low-density polyethylene layer to 80 μm and using low-density polyethylene (Novatec LD YF30 produced by Japan Polyethylene Corp.) with a bending modulus of elasticity of 130 MPa.

For the delaminatable containers in Comparative Examples 1-3 and Example 1, dischargeability test and oxygen barrier property test were performed to obtain the results below. In the dischargeability test, the performance of discharging the contents at the same level as Example 1 was categorized into O and the performance worse than Example 1 was categorized into X. In the oxygen barrier property test, the oxygen barrier properties at the same level as Example 1 were categorized into O and the properties worse than Example 1 were categorized into X. As shown in Table 1, it was found that the delaminatable container in Example 1 was excellent in both the dischargeability and the oxygen barrier properties.

TABLE 1

| | Comparative Example 1 | Comparative Example 2 | Comparative Example 3 | Example 1 |
|---|---|---|---|---|
| Dischargeability Test | ○ | X | X | ○ |
| Oxygen Barrier Property Test | X | ○ | ○ | ○ |

REFERENCE SIGNS LIST

0: Delaminatable Container, 3: Container Body, 5: Valve Member, 7: Storage Portion, 9: Mouth, 11: Outer Layer, 12: Outer Shell, 13: Inner Layer, 14: Inner Bag, 15: Fresh Air Inlet, 23: Cap, 27: Bottom Seal Protrusion, 31: Shrink Film, 2: Pinhole, 33: Circumferential Perforations, 34: Axial Perforations, 101: Adhesion Strip, 102: Space

The invention claimed is:

1. A delaminatable container, containing a container body having an outer shell and an inner bag, the inner bag to be shrunk with a decrease in contents, wherein the inner bag is composed of an inner layer including an outside layer, an adhesion layer, and an inside layer in order from a container outer surface side, the outside layer includes an EVOH layer, the inside layer has a thickness from 60 to 200 μm and a bending modulus of elasticity of 250 MPa or less, a value of (thickness of the inside layer / thickness of the EVOH layer) is from 1.1 to 5, and the entire inner layer has a thickness from 100 to 250 μm.

2. The container of claim 1, wherein the inside layer contains low-density polyethylene or linear low-density polyethylene.

3. The container of claim 1, wherein the inside layer has a thickness from 70 to 150 μm and a bending modulus of elasticity of 200 MPa or less, the value of (thickness of the inside layer / thickness of the EVOH layer) is from 1.5 to 4, and the entire inner layer has a thickness from 120 to 200 μm.

4. A delaminatable container, comprising:

a storage portion to store contents;

a mouth to discharge the contents from the storage portion; and a container body having an outer shell and an inner bag, the inner bag to be shrunk with a decrease in contents, wherein the outer shell includes a fresh air inlet, in the storage portion, communicating an external space of the container body with an intermediate space between the outer shell and the inner bag, and grooved ribs are provided to sandwich the fresh air inlet, wherein the grooved ribs are provided to sandwich the fresh air inlet from both sides in a circumferential direction of the storage portion, the grooved ribs includes first and second grooved ribs provided to extend inclined circumferentially away from the fresh air inlet toward the mouth, and the first and second grooved ribs are provided at an angle from 30 to 100 degrees in a front view.

5. The container of claim 4, wherein the fresh air inlet and the grooved ribs are provided in an approximately same plane.

6. The container of claim 4, wherein the grooved ribs extend to arcuately surround the fresh air inlet.

7. The container of claim 6, wherein the grooved ribs are composed of a plurality of grooves separated from each other in a circumferential direction of the grooved ribs.

8. The container of claim 6, wherein the grooved ribs include a plurality of arcs separated from each other in a direction away from the fresh air inlet.

9. The container of claim 4, wherein the fresh air inlet is formed in a valve member mounting recess provided in the storage portion, and the grooved ribs are provided to sandwich the valve member mounting recess.

10. The container of claim 4, wherein the grooved ribs have a semicircular cross section.

11. A delaminatable container, comprising:

a storage portion to store contents;

a mouth to discharge the contents from the storage portion; and a container body having an outer shell and an inner bag, the inner bag to be shrunk with a decrease in contents, wherein the outer shell includes a fresh air inlet, in the storage portion, communicating an external space of the container body with an intermediate space between the outer shell and the inner bag, and grooved ribs are provided to sandwich the fresh air inlet, wherein the grooved ribs are provided to sandwich the fresh air inlet from both sides in a circumferential direction of the storage portion, the grooved ribs includes first and second grooved ribs provided to extend inclined circumferentially away from the fresh air inlet toward the mouth, and the first and second grooved ribs are provided to have an intersection of extensions thereof, a distance between the intersection and a center of the fresh air inlet being from 5 to 35 mm in a front view.

12. The container of claim 11, wherein the fresh air inlet and the grooved ribs are provided in an approximately same plane.

13. The container of claim 11, wherein the grooved ribs extend to arcuately surround the fresh air inlet.

14. The container of claim 13, wherein the grooved ribs are composed of a plurality of grooves separated from each other in a circumferential direction of the grooved ribs.

15. The container of claim 13, wherein the grooved ribs include a plurality of arcs separated from each other in a direction away from the fresh air inlet.

16. The container of claim 11, wherein the fresh air inlet is formed in a valve member mounting recess provided in the storage portion, and the grooved ribs are provided to sandwich the valve member mounting recess.

17. The container of claim 11, wherein the grooved ribs have a semicircular cross section.

* * * * *